US010909783B2

(12) United States Patent
Tsuchikiri et al.

(10) Patent No.: US 10,909,783 B2
(45) Date of Patent: Feb. 2, 2021

(54) METHOD OF AUTOMATICALLY GENERATING VEHICLE TEST GROUP IDENTIFICATION INFORMATION, PROGRAM, ELECTRONIC CONTROL UNIT, AND VEHICLE

(71) Applicant: HONDA MOTOR CO., LTD., Tokyo (JP)

(72) Inventors: Hideyuki Tsuchikiri, Wako (JP); Wataru Endo, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 189 days.

(21) Appl. No.: 16/131,191

(22) Filed: Sep. 14, 2018

(65) Prior Publication Data

US 2019/0088042 A1 Mar. 21, 2019

(30) Foreign Application Priority Data

Sep. 15, 2017 (JP) ..... 2017-177790

(51) Int. Cl.
*G07C 5/08* (2006.01)
*G07C 5/00* (2006.01)

(52) U.S. Cl.
CPC ..... *G07C 5/085* (2013.01); *G07C 5/008* (2013.01)

(58) Field of Classification Search
CPC ..... G07C 5/008; G07C 5/08; G07C 5/085
USPC ..... 701/29.6
See application file for complete search history.

(56) References Cited

U.S. PATENT DOCUMENTS 9,990,781 B2 * 6/2018 Haidar ..... G07C 5/008
2009/0276115 A1 * 11/2009 Chen ..... G07C 5/008 701/29.6
2013/0342368 A1 * 12/2013 Nathanson ..... G08G 1/0965 340/903
2015/0094929 A1 * 4/2015 Bell ..... G07C 5/008 701/99
2016/0070527 A1 * 3/2016 Ricci ..... G06F 3/165 715/716
2016/0093216 A1 * 3/2016 Lee ..... G06O 50/30 340/870.11
2016/0247331 A1 * 8/2016 Cacabelos ..... G07C 5/0808
2016/0328890 A1 * 11/2016 Keane ..... G07C 5/008
2016/0335816 A1 * 11/2016 Thoppae ..... H04L 67/42
(Continued)

FOREIGN PATENT DOCUMENTS

JP 2017-44483 A 3/2017

OTHER PUBLICATIONS

"Locating vehicle "Test Group" and "Engine Family Numbers"",California Environmental Protection Agency Air Resources Board,[online], [searched on Aug. 12 in Heisei 29 (2017)], Internet <URL:https://www.arb.ca.gov/msprog/consumer_info/testgroup_efn.htm>, cited in Specification (2 pages).

*Primary Examiner* — Atul Trivedi
(74) *Attorney, Agent, or Firm* — Westerman, Hattori, Daniels & Adrian, LLP

(57) ABSTRACT

There is provided a method of automatically generating a test group ID for generating and storing the test group ID of a vehicle having an electronic control unit including a storage. The method includes reading VIN stored in a storage, by the electronic control unit; generating a test group ID based on a model year included in the VIN; and storing the generating test group ID in the storage.

18 Claims, 21 Drawing Sheets

(56) References Cited

U.S. PATENT DOCUMENTS

| | | | | |
|---|---|---|---|---|
| 2017/0039784 | A1* | 2/2017 | Gelbart | G07C 5/0808 |
| 2017/0098200 | A1* | 4/2017 | Merg | G06Q 10/20 |
| 2017/0101054 | A1* | 4/2017 | Dusane | G08G 1/205 |
| 2017/0132854 | A1* | 5/2017 | Merg | G07C 5/0808 |
| 2017/0316621 | A1* | 11/2017 | Jefferies | G06Q 50/30 |
| 2018/0096539 | A1* | 4/2018 | Merg | G06Q 10/20 |
| 2019/0026962 | A1* | 1/2019 | Gintz | G07C 5/12 |
| 2019/0166635 | A1* | 5/2019 | McColgan | H04W 12/0013 |
| 2019/0228654 | A1* | 7/2019 | Olsen | G08G 1/096775 |
| 2019/0279440 | A1* | 9/2019 | Ricci | H04W 4/48 |
| 2019/0279447 | A1* | 9/2019 | Ricci | B60R 25/25 |

* cited by examiner

METHOD OF AUTOMATICALLY GENERATING VEHICLE TEST GROUP IDENTIFICATION INFORMATION, PROGRAM, ELECTRONIC CONTROL UNIT, AND VEHICLE

CROSS REFERENCES TO RELATED APPLICATIONS

The present application claims priority under 35 U.S.C. § 119 to Japanese Patent Application No. 2017-177790, filed on Sep. 15, 2017, entitled "Method of Automatically Generating Vehicle Test Group Identification Information, Program, Electronic Control Unit, and Vehicle." The contents of this application are incorporated herein by reference in their entirety.

TECHNICAL FIELD

The present disclosure relates to a method of automatically generating test group identification information, a program, an electronic control unit, and a vehicle for automatically generating test group identification information or an engine family number (hereinafter, test group identification information or an engine family number are also collectively referred to as "test group ID") of a vehicle and for storing the generated test group identification information to satisfy requirements of public regulation.

BACKGROUND

Conventionally, approval for emission control in north America (including the United States and Canada) is to be obtained test group ID by test group ID. Here, test group identification information (test group ID) refers to identification information that is set by a vehicle manufacturer based on a model year (hereinafter also called "MY") of a vehicle and emission related information (such as an engine specification, emission use, applicable emission control, and a vehicle category). Like this, approval for emission in North America is granted for the MY of a vehicle regardless of the presence or absence of change in the vehicle specification. It is to be noted that the MY is used to indicate a year in which a vehicle was manufactured in North America.

In order to conform with the IM inspection prescribed in Vehicle Inspection Maintenance Regulations of US Environmental Protection agency, test group identification information (test group ID) is marked as "information indicating conformity to laws" on a VECI label (Vehicle Emission Control Information Label), and is affixed to the back of the hood of a vehicle (see California Environmental Protection Agency Air Resources Board, "Locating vehicle "Test Group" and "Engine Family Numbers"", [online], [searched on August 12 in Heisei 29 (2017)], Internet <URL:https://www.arb.ca.gov/msprog/consumer_info/testgroup_e-fn.htm>).

Furthermore, in North America, due to revision of the laws of On-Board-Diagnostics established by California Air Resources Board (CARB), each model in 2019 and afterward is obligated to store a Test group ID of the IM inspection in a memory in an electronic control unit (hereinafter also referred to as "ECU") mounted in the vehicle so that the Test group ID is readable by a generic tool (GST). California Air Resources Board in the United States demands that a test group ID or an engine family number (hereinafter also called "EFN") be allowed to be output to a diagnostic device.

In the revision of OBD made by CARB issued in 2003, it was already determined that "for all vehicles with a MY of 2005 and afterward, a vehicle identification number (VIN) information should be able to be read by a GST". For instance, as described in Japanese Unexamined Patent Application Publication No. 2017-44483, although it is publicly known that a VIN specific to a vehicle is stored in an ECU mounted in the vehicle, a test group ID has never been stored in an ECU mounted in the vehicle.

When a test group ID is stored in a memory in an electronic control unit (ECU) mounted in a vehicle, a test group ID for each model year (MY) of the vehicle has to be generated and stored in the memory in the electronic control unit (ECU) mounted in the vehicle.

Meanwhile, the technology described in Japanese Unexamined Patent Application Publication No. 2017-44483 stores a VIN specific to a vehicle in a memory in an ECU mounted in the vehicle, and no description or suggestion is provided for storing a test group ID in a memory in an ECU mounted in the vehicle.

SUMMARY

The present disclosure has been made in consideration of such a problem. The present application describes a method of automatically generating test group ID, a program, an electronic control unit, and a vehicle that are capable of generating a test group ID of a vehicle more easily and more reliably and of storing the test group ID in an ECU mounted in the vehicle so that the following obligation made by the revision of the laws of OBD established by CARB: a test group ID set for each MY of a vehicle must be stored in a memory in an ECU mounted in a vehicle so that the test group ID can be read by a GST.

(1) The disclosure in the present application relates to a method of automatically generating test group identification information for generating and storing test group identification information or engine family information (for instance, the later-described "test group ID") of a vehicle having an electronic control unit (for instance, the later-described "electronic control unit 1") including a storage (for instance, the later-described "storage 15"), the method including: a VIN reading step (for instance, the later-described "reading") by the electronic control unit a vehicle identification number (for instance, the later-described "VIN") stored in the storage; a test group ID generation step (for instance, the later-described "generation") a manufacturer common model year in the test group identification information or the engine family information based on information indicating a model year (for instance, the later-described "MY") included in the vehicle identification number (for instance, the later-described "VIN") read in the reading; and a test group ID storage step (for instance, the later-described "storing") the test group identification information or the engine family information generated in the generating in the storage.

According to the method of automatically generating test group identification information, for example, a storage area, information, and a program are set and stored beforehand in an electronic control unit mounted in a vehicle by an ECU supplier or an electronic control unit manufacturing department. In response to generation of a VIN, a Test group ID is automatically generated. Consequently, reduction in the burden of workers can be achieved and manual transcription can be omitted, and thus man-made mistakes or risk of statutory violation by intentional falsification can be eliminated.

It is to be noted that the "reduction in the burden of workers" includes shifting an expected increase in the man-hour load when writing work is performed on an assembly line for finished vehicles to the man-hour load of the production line of an ECU manufacturing department of a vehicle manufacturing company or the production line of an ECU supplier which is a different company. In either case, the shifted man-hour load is absorbed by a process before the assembly process for finished vehicle, and thus the increase in the number of processes is likely to be absorbed, thereby providing more effectiveness in the entire production.

(2) The method of automatically generating test group identification information according to (1), in which the electronic control unit has related information beforehand other than the model year used for generation of the test group identification information (for instance, the later-described "emission control category", "vehicle category", "engine displacement"), and in the test group ID generation step, the electronic control unit further generates test group identification information based on the related information used for generation of the test group identification information.

According to (2), for example, test group identification information is automatically generated based on the related information used for generation of the test group identification information.

Consequently, test group identification information can be automatically generated by preparing the related information used for generation of the test group identification information when the attributes of a vehicle are determined, and test group identification information can be automatically generated in the current manufacturing process or at the time of replacement of an electronic control unit (ECU) in a service department.

(3) The disclosure in the present application relates to a method of automatically generating test group identification information (for instance, the later-described "test group ID") for generating and storing test group identification information or engine family information of a vehicle having an electronic control unit including a storage, the method including: receiving a VIN receiving step (for instance, the later-described "receiving") a vehicle identification number (for instance, the later-described "VIN") by a management server (for instance, the later-described "management server 4") from a diagnostic device (for instance, the below-described "diagnostic device 3A") or a writing device (for instance, the later-described "writing device 2A") connected to allow communication with the management server; a test group ID generation step (for instance, the below-later "generation") a manufacturer common model year in the test group identification information or the engine family information based on information indicating a model year (for instance, the later-described "MY") included in the vehicle identification number received in the receiving by the management server; and a test group ID transmission step (for instance, the later-described "transmitting") by the management server the test group identification information or the engine family information generated in the generating to the diagnostic device or the writing device.

According to (3), for example, programs for test group ID automatic generation can be managed in a unified manner by the management server, thereby providing more efficient management related to maintenance of the programs for test group ID automatic generation.

(4) The method of automatically generating test group identification information according to (3), in which the management server has related information beforehand other than the model year (for instance, the later-described "emission control category", "vehicle category", "engine displacement") used for generation of the test group identification information or the engine family information, and in the test group ID generation step, the electronic control unit further generates test group identification information based on the related information used for generation of the test group identification information or the engine family information.

According to (4), for example, the management server automatically generates test group identification information or engine family information based on the related information used for generation of the test group identification information or the engine family information.

Consequently, the same effect as that of (2) can be achieved.

(5) The disclosure in the present application relates to a method of automatically generating test group identification information (for instance, the later-described "test group ID") for generating and storing test group identification information or engine family information of a vehicle having an electronic control unit (for instance, the later-described "electronic control unit 1B"), the method including: a test group ID generation step (for instance, the later-described "generating") a manufacturer common model year in the test group identification information or the engine family information by the diagnostic device (for instance, the later-described "diagnostic device 3B") or the writing device (for instance, the later-described "writing device 2B") connected to allow communication with the electronic control unit based on information indicating a model year (for instance, the later-described "MY") included in the vehicle identification number; and a test group ID storage step (for instance, the later-described "storing") the test group identification information or the engine family information generated in the generating in a storage area of the electronic control unit.

According to (5), for example, programs for test group ID automatic generation can be managed in a unified manner by the diagnostic device or the writing device, and thus for instance, when the electronic control unit (ECU) is replaced due to a cause such as a fault, a test group ID can be automatically generated by the diagnostic device. Also, at the time of production (for instance, an assembly process) of finished vehicles, a test group ID can be automatically generated by the writing device.

Thus, at the time of replacement of the electronic control unit (ECU), additional load of a user can be protected, and the electronic control unit (ECU) can be replaced more easily and more reliably at the service department. Also, at the time of production (for instance, an assembly process) of finished vehicles, the burden of workers can be reduced.

Since a test group ID is automatically generated in the electronic control unit, the possibility of man-made mistakes or intentional falsification can be eliminated or man-made mistakes or intentional falsification can be prevented.

(6) The method of automatically generating test group identification information according to (5), in which the diagnostic device or the writing device has related information beforehand other than the model year (for instance, the later-described "emission control category", "vehicle category", "engine displacement") used for generation of the test group identification information or the engine family information, and in the generating, the diagnostic device or the writing device further generates test group identification information or the engine family information based on the related information used for generation of the test group identification information or the engine family information.

According to (6), for example, the diagnostic device or the writing device automatically generates test group identification information based on the related information used for generation of the test group identification information or the engine family information.

Consequently, the same effect as that of (2) can be achieved.

(7) A program that causes an electronic control unit (for instance, the later-described "electronic control unit 1") mounted in a vehicle to execute the steps in the method of automatically generating test group identification information according to (1) or (2).

(8) A program that causes the management server (for instance, the later-described "management server 4") connected to allow communication with the diagnostic device (for instance, the later-described "diagnostic device 3A") or the writing device (for instance, the later-described "writing device 2A") to execute the receiving, the generating, and the transmitting in the method of automatically generating test group identification information according to (3) or (4).

(9) A program that causes the diagnostic device (for instance, the later-described "diagnostic device 3A") or the writing device (for instance, the later-described "writing device 2A") connected to allow communication with the electronic control unit (for instance, the later-described "electronic control unit 1B") mounted in the vehicle to execute the steps in the method of automatically generating test group identification information according to (5) or (6).

With the programs in (7) to (9), for example, the same effect as that of the method of automatically generating test group identification information according to (1) to (6) can be achieved.

(10) An electronic control unit (for instance, the later-described "electronic control unit 1") that executes the steps in the method of automatically generating test group identification information according to (1) or (2).

With the electronic control unit in (10), for example, the same effect as that of the method of automatically generating test group identification information according to (1) or (2) can be achieved.

(11) A vehicle including the electronic control unit (for instance, the later-described "electronic control unit 1") according to (10).

With the vehicle in (11), for example, the same effect as that of the method of automatically generating test group identification information according to (1) or (2) can be achieved.

(12) An electronic control unit (for instance, the later-described "electronic control unit 1") including the program according to (7).

With the electronic control unit in (12), for example, the same effect as that of the method of automatically generating test group identification information according to (1) or (2) can be achieved. In the above explanation of the exemplary embodiment, specific elements with their reference numerals are indicated by using brackets. These specific elements are presented as mere examples in order to facilitate understanding, and thus, should not be interpreted as any limitation to the accompanying claims.

According to the present disclosure, for example, it is possible to provide a method of automatically generating test group ID, a program, an electronic control unit, and a vehicle that, in management of a test group ID or an engine family number of the vehicle, are capable of generating the test group ID or the engine family number more easily and more reliably and of storing the test group ID or the engine family number in an ECU mounted in the vehicle.

BRIEF DESCRIPTION OF THE DRAWINGS

The advantages of the disclosure will become apparent in the following description taken in conjunction with the following drawings.

DETAILED DESCRIPTION

[First Embodiment]

A test group identification information automatic generative system 1000 in the present disclosure is a system related to automatic generation of a test group ID at the time of production (for instance, an assembly process in which the engine is installed in the vehicle body) of finished vehicles, or at the time of replacement of an electronic control unit 1 due to a cause such as a fault after vehicles come on the market.

Hereinafter, a preferable embodiment of the test group identification information automatic generation system 1000 of the present disclosure will be described with reference to FIGS. 1 to 3.

[Configuration of Test Group Identification Information Automatic Generation System 1000]

Figure 1:
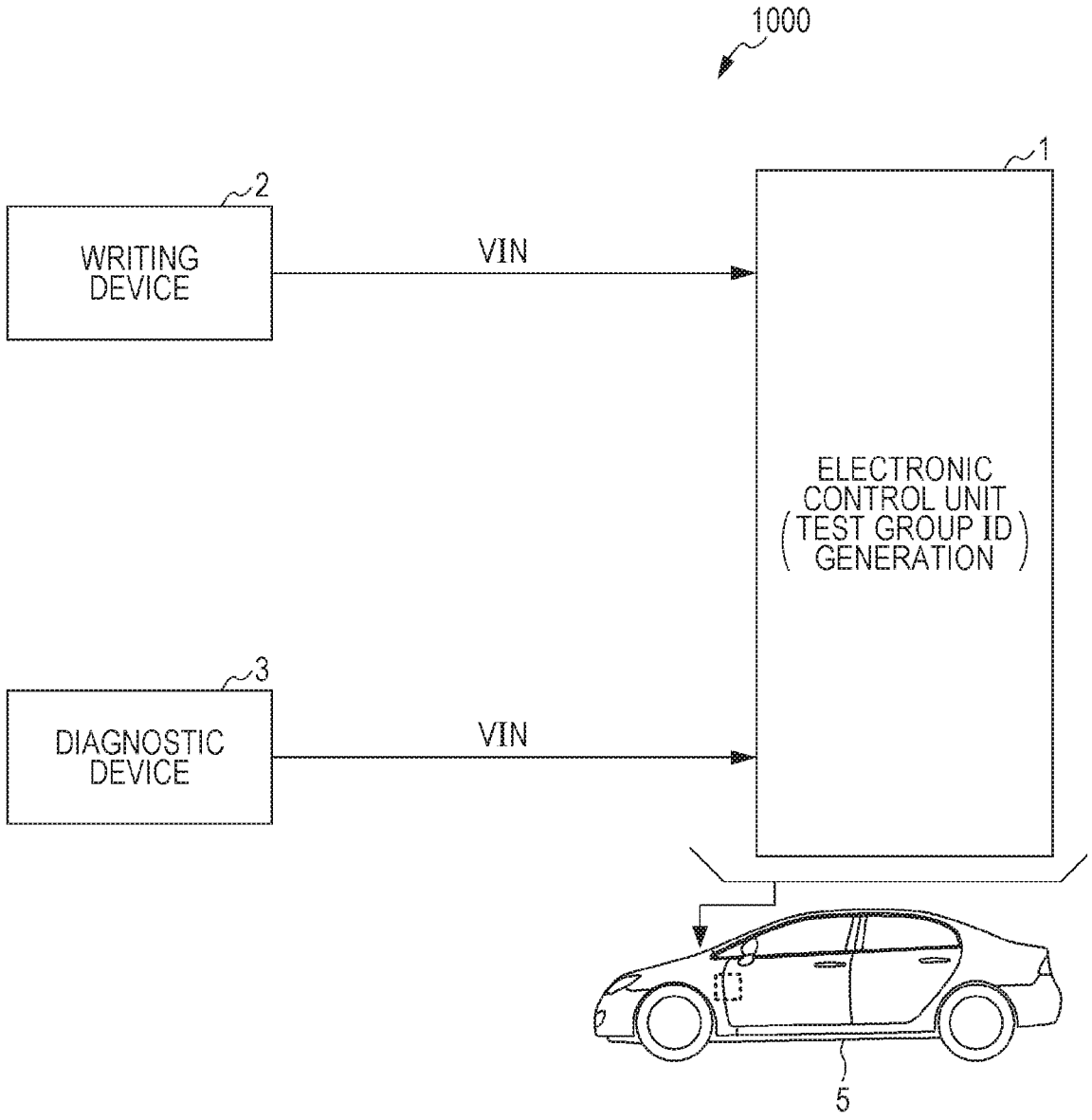
FIG. 1 is a diagram illustrating the system configuration of a test group identification information automatic generation system.

As illustrated in FIG. 1, the test group identification information automatic generation system 1000 includes the electronic control unit 1, a writing device (line end tester or LET) 2, a diagnostic device (diagnostic tool or DS), and a vehicle 5.

[Electronic Control Unit 1]

In the vehicle 5, various electronic control units 1 are mounted, such as an electronic control unit 1 (also called an "engine ECU") for fuel injection control, an electronic control unit 1 for brake control, and an electronic control unit 1 for transmission gear ratio control, and the electronic control units 1 are connected via a communication line.

For instance, the engine ECU is responsible for engine control, and controls the amount of fuel injection by an injector and the ignition timing by an igniter based on various sensor signals so that the engine is operated under optimal conditions. Also, the electronic control unit for brake control has, for instance, anti-lock brake system (ABS) function, and reduces an occurrence of wheel slip by adjusting the braking force to the wheels. Also, the electronic control unit 1 for transmission gear ratio control electronically controls, for instance, the shift position of automatic transmission based on information on the number of revolution of the engine and a throttle valve opening, for instance.

For instance, connectors are provided on a communication line, and a connector and a connector on the side of a writing device 2 or a diagnostic device 3 are connected via a communication cable, and thus various information stored in the electronic control units 1 are read/written as appropriate by the writing device 2 or the diagnostic device 3. It is to be noted that connection between an electronic control unit 1 and the writing device 2 or the diagnostic device 3 is not limited to a wire-line connection using connectors. For instance, connection may be made by wireless communication.

Figure 2:
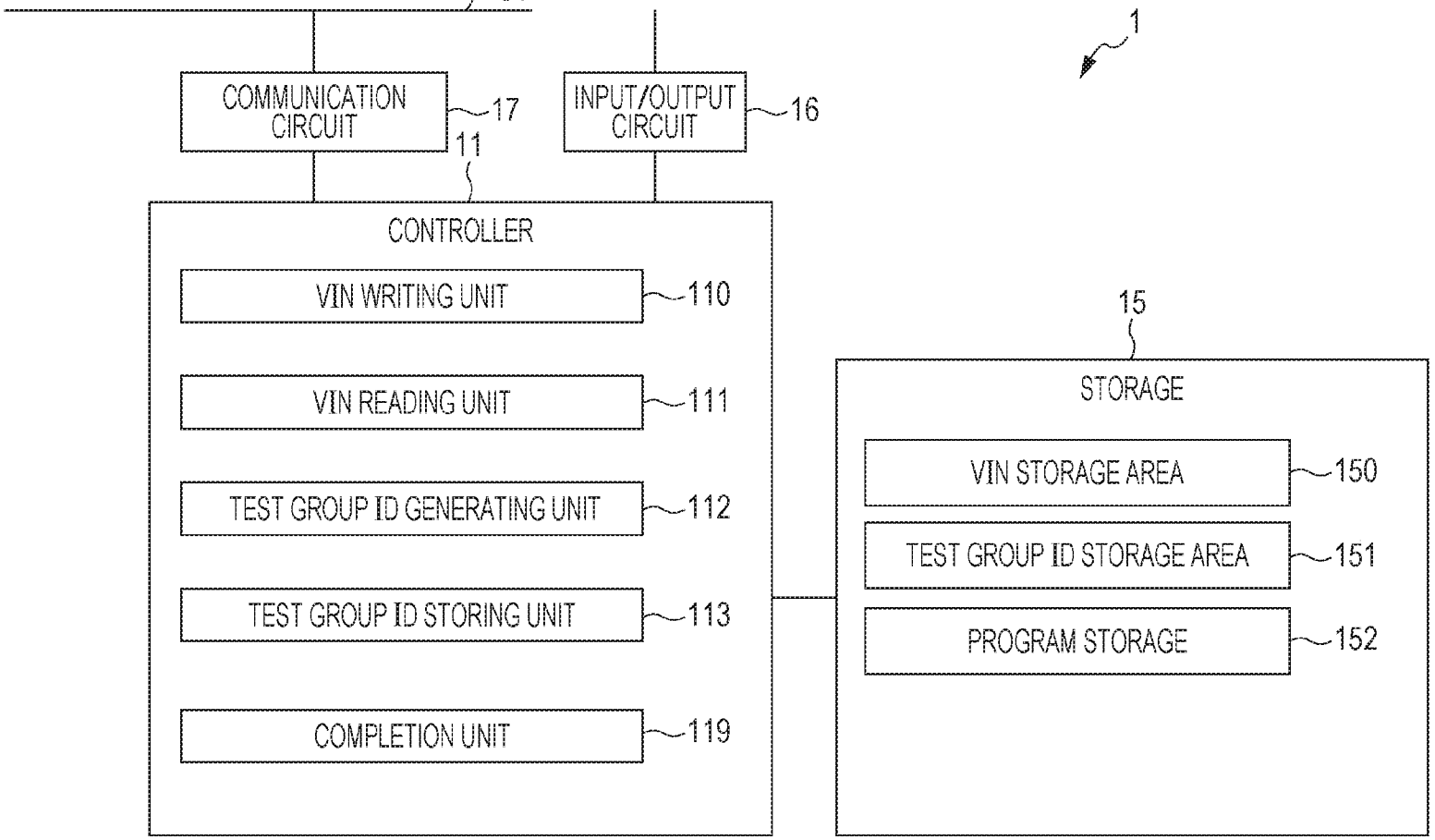
FIG. 2 is a diagram illustrating the configuration of an electronic control unit.
Figure 3:
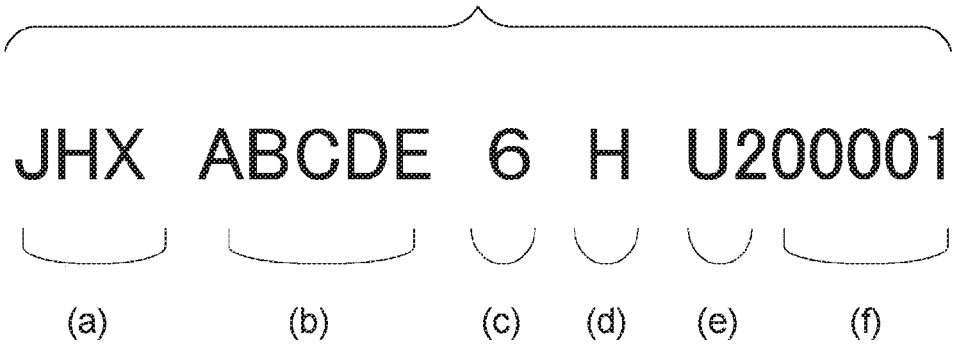
FIG. 3 illustrates an example of a vehicle identification number (VIN).

The functional configuration of the electronic control unit 1 is illustrated in FIG. 2. As illustrated in FIG. 2, the electronic control unit 1 includes a controller 11 including a CPU, a storage 15 including a ROM, a RAM, and an EEPROM, an input/output circuit 16 for inputting various sensor signals and outputting various control signals, and a communication circuit 17 for performing data processing via a communication line 51. The electronic control unit 1 performs control related to the electronic control unit 1 based on the various sensor signals.

The electronic control unit 1 according to a first embodiment is such an electronic control unit among multiple electronic control units 1 to n mounted in a vehicle, in which a vehicle identification number (VIN) specific to the vehicle is stored in a VIN storage area 150 included in the storage 15 of the electronic control unit. In this case, the VIN storage area 150 may be an EEPROM. It is to be noted that an electronic control unit including the VIN storage area 150 that stores a VIN may be an engine ECU, and/or another electronic control unit 1. Also, a VIN may be recorded in multiple electronic control units 1.

At the time of production (for instance, an assembly process in which the engine is installed in the vehicle body) of finished vehicles, the electronic control unit 1 according to the first embodiment indicates the electronic control unit 1 mounted in each vehicle unless specifically stated, and when an electronic control unit 1 is replaced due to a cause such as a fault after vehicles come on the market, the electronic control unit 1 according to the first embodiment indicates a new electronic control unit 1 which is newly incorporated to replace an electronic control unit 1 which has failed.

The function of a CPU 11 (hereinafter also called a "controller 11") and the storage 15 will be described with reference to FIG. 2. As described above, the controller 11 (the CPU 11) executes programs read from the storage 15, reads information from the storage 15 at the time of execution, writes information to the storage 15, sends and receives a signal via the input/output circuit 16, and performs data communication via the communication circuit 17.

The controller 11 (the CPU 11) causes the electronic control unit 1 to function as one of predetermined units (hereinafter, collectively referred to as the "test group ID automatic generation unit") by executing one of the programs (hereinafter, collectively referred to as the "program for test group ID automatic generation").

Also, the controller 11 (the CPU 11) causes the electronic control unit 1 to perform predetermined steps (hereinafter, collectively referred to as the "test group ID automatic generation step") by executing one of the programs.

Hereinafter, the function of the controller 11 (the CPU 11) will be described from the viewpoint of the test group ID generation unit. A description based on the viewpoint of the test group ID generation step (method) can be made by replacing "unit" with "step", thus a detailed description is omitted.

Before the function of the controller 11 (the CPU 11) is described, the storage 15 will be described first. As illustrated in FIG. 2, the storage 15 includes the VIN storage area 150, a test group ID storage area 151, and a program storage 152 containing a program for test group ID automatic generation.

The VIN storage area 150 is a storage area into which VIN is written by the writing device 2 or the diagnostic device 3 at the time of production (for instance, an assembly process in which the engine is installed in the vehicle body) of finished vehicles or at the time of replacement of the electronic control unit 1.

The VIN storage area 150 is pre-set in the electronic control unit 1 to be assembled or in a new electronic control unit to be newly incorporated at the time of replacement, for instance, by an ECU supplier or an electronic control unit manufacturing department. It is to be noted that once VIN is written to the VIN storage area 150 by the writing device 2 or the diagnostic device 3, and when the VIN written to the VIN storage area 150 is confirmed to be the same as the vehicle identification number stamped on the vehicle body, from then on, the VIN storage area 150 is for read only, and writing is prohibited to prevent unauthorized writing of VIN to the VIN storage area 150.

Here, the vehicle identification number (VIN) will be described. FIG. 3 illustrates an example of VIN. 17-digit VIN is defined by ISO 3779 and ISO 3780. As illustrated in FIG. 3, symbol a for the first 3 letters (counted from the left of the horizontally written character string) indicates the country of production and a manufacturer. Also, the second symbol b for 5 letters indicates a vehicle attribute (model number classification). Also, the third symbol c for 1 digit is used as a check digit, and is used for checking the presence or absence of mistake in inputting VIN. Also, the fourth symbol d for 1 letter indicates a model year (MY). The fifth symbol e for 2 alphanumerics indicates a factory symbol, and the sixth symbol f for 5 digits indicates a serial number.

The model year indicates a year in which the vehicle was manufactured, and is expressed by an alphabetical letter which corresponds to a numeral or a year of the least significant digit of a Christian year by a model code table.

For instance, "1" for the year 2001, "2" for the year 202, "b" for the year 2011, and "c" for the year 2012.

When the symbol b (vehicle attribute) is defined by a manufacturer, a vehicle specification corresponding to the later-described "manufacturer common vehicle category", "engine displacement", and "law category" in the test group ID is already defined.

The test group ID storage area 151 is a storage area to which a test group ID is written by the later-described test group ID generation unit 112, and is set for the electronic control unit beforehand similarly to the VIN storage area 150. The test group ID storage area 151 may be provided in an EEPROM similarly to the VIN storage area 150. It is to be noted that once a test group ID is written to the test group ID storage area 151, from then on, the test group ID storage area 151 is for read only, and writing to the test group ID storage area 151 is prohibited.

Figure 4:
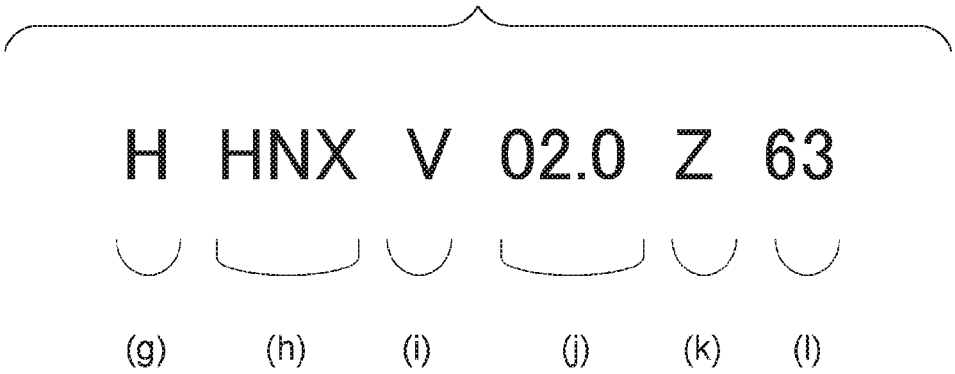
FIG. 4 illustrates an example of a test group ID.

Here, the test group ID will be described. FIG. 4 illustrates an example of a test group ID. The test group ID consists of 12 symbols. As illustrated in FIG. 4, symbol g for the first letter (counted from the left of the horizontally written character string) indicates a manufacturer common model year (MY), and the second symbol h for 3 letters indicates a manufacture manufacturer. The third symbol i for 1 letter indicates a manufacturer common vehicle category. For instance a passenger car is denoted by V, and a track is denoted by T. Also, the fourth symbol j for 4 digits indicates an engine displacement. For instance, the displacement of 2.0 L is denoted by 02.0. The fifth symbol k for 1 letter indicates an ID set by a manufacturer for each model year. The sixth symbol l for 2 digits indicates a law category.

A program for test group ID automatic generation is pre-stored in the program storage 152, for instance, by an ECU supplier or an electronic control unit manufacturing department. When a vehicle attribute is determined, a vehicle category and an emission control category corresponding to the attribute (vehicle model number) of the vehicle may be provided as fixed parameter values in the program for test group ID automatic generation.

The program for test group ID automatic generation may be formed of one or more program groups which are divided by function in any manner. For instance, the programs may be divided so as to correspond to the later-described VIN writing unit 110, VIN reading unit 111, test group ID generation unit 112, test group ID storing unit 113, and completion unit 119. A single program may correspond to a function combining one or more functional units. Conversely, each functional unit may be further divided by function, and a program may correspond to each sub-divided functional unit. When a program is divided so as to include multiple sub-programs like this, start-up of another program and transfer of processed data (or parameters) to another program may be performed, for instance, by applying a well-known art such as interprocess communication.

Next, the function of the control unit 11 (the CPU 11) will be described. As illustrated in FIG. 2, the control unit 11 (the CPU 11) includes a VIN writing unit 110, a VIN reading unit 111, a test group ID generation unit 112, a test group ID storing unit 113, and a completion unit 119.

In response to the later-described writing command for a vehicle identification number (VIN) from the writing device 2 or the diagnostic device 3, the VIN writing unit 110 stores the vehicle identification number (VIN) in the VIN storage area 150 of the electronic control unit 1, then sets the VIN storage area 150 to a VIN write completion state resulting in a data writing prohibited area. The VIN writing unit 110 notifies the writing device 2 or the diagnostic device 3 of VIN write completion (normal completion).

In response to storing of the VIN in the VIN storage area 150 by the VIN writing unit 110, the VIN reading unit 111 reads the VIN stored in the VIN storage area 150. In this manner, unwritten VIN and erroneous VIN input can be prevented.

In response to reading of the VIN from the VIN storage area 150 by the VIN reading unit 111, the test group ID generation unit 112 determines and generates a test group ID. When fixed parameter values are provided in the program for test group ID automatic generation, the test group ID generation unit 112 determines, and generates a test group ID by checking the VIN information against the fixed parameter values provided in the program for test group ID automatic generation. The VIN may be transferred from the VIN writing unit 110 to the test group ID generation unit 112, for instance, by interprocess communication.

In response to generation of the test group ID by the test group ID generation unit 112, the test group ID storing unit 113 stores the generated test group ID in the test group ID storage area 151, and sets the test group ID storage area 151 to a test group ID write completion state resulting in a data writing prohibited area.

In response to storing of the test group ID in the test group ID storage area 151 by the test group ID storing unit 113, the completion unit 119 completes test group ID automatic generation function.

The completion unit 119 may notify the writing device 2 or the diagnostic device 3 that generation of a test group ID and storing of the test group ID in the test group ID storage area 151 have been completed.

[Writing Device 2]

Figure 5:
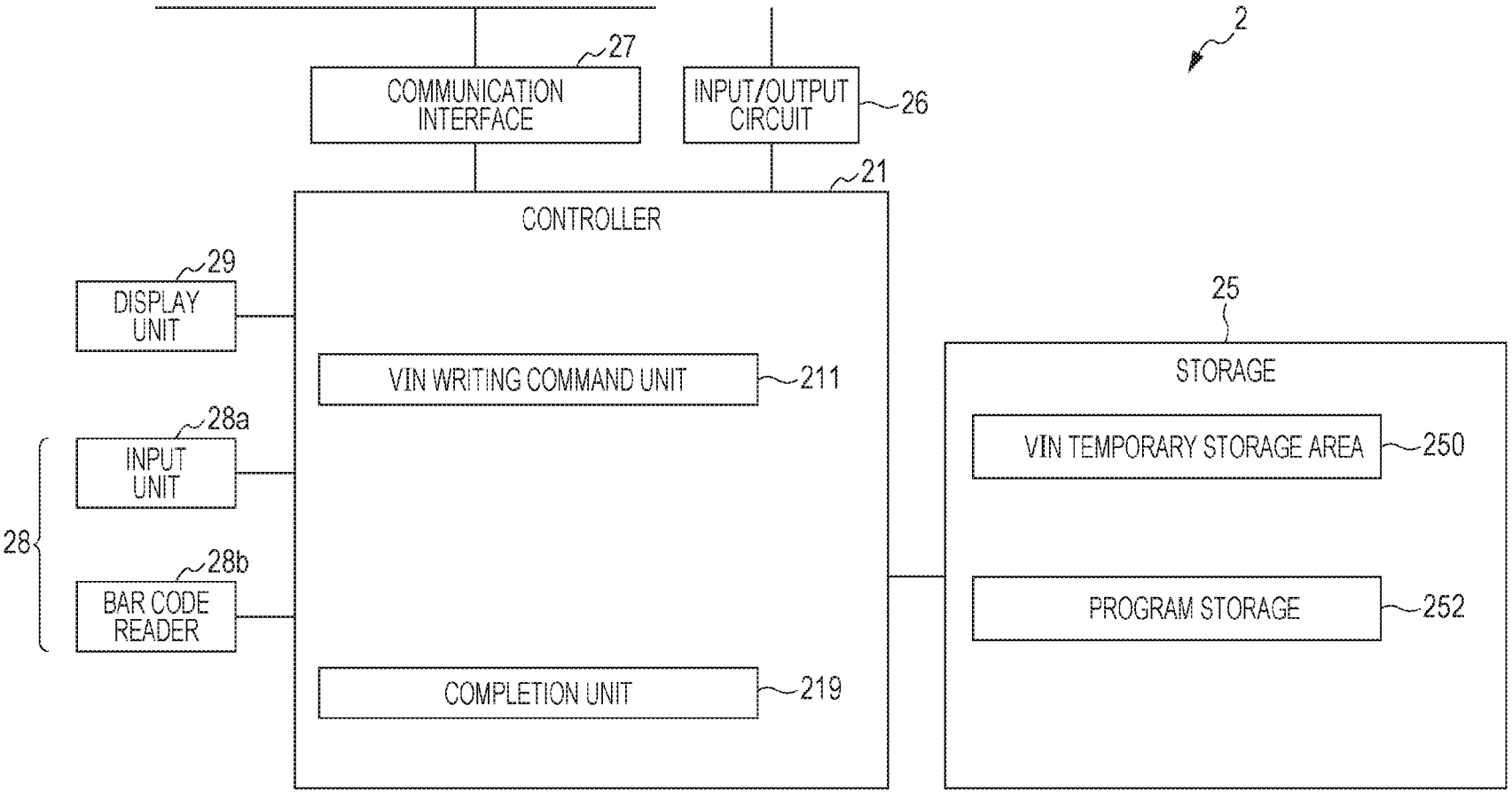
FIG. 5 is a diagram illustrating the configuration of a writing device.

The basic configuration of the writing device 2 is illustrated in FIG. 5. As illustrated in FIG. 5, similarly to the electronic control unit 1 described above, in the writing device 2, the controller 21 including a CPU includes a storage 25 having a ROM, a RAM, and an EEPROM, an input/output circuit 26 for inputting various sensor signals and outputting various control signals, a communication interface 27 for the electronic control unit 1, an input unit 28 such as an input unit **28*a* for inputting an instruction by an operator and a bar code reader 28*b* for inputting label information, and a display unit 29 for displaying a processing result or the like. Also, the writing device 2 performs control related to the writing device 2 based on an instruction by an operator, and communication data transmitted and received to and from the electronic control unit 1**.

[Function of Writing Device 2]

As illustrated in FIG. 5, in the writing device 2, the storage 25 includes a VIN temporary storage area 250, and a program storage 252, and the writing device 2 functions as a VIN write command unit 211 and a completion unit 219 by executing programs stored in the program storage 252 by the controller 21.

At the time of production (for instance, an assembly process in which the engine is installed in the vehicle body) of finished vehicles, the VIN write command unit 211 reads the VIN of a vehicle body, for instance, from a label by the bar code reader 28*b*, and stores the read VIN in the VIN temporary storage area 250, and subsequently transmits a write command for the VIN stored in the VIN temporary storage area 250 to the electronic control unit 1 mounted in the vehicle 5 via the communication interface 27.

When receiving a completion notification for test group ID generation from the electronic control unit 1, in response to the completion notification, the completion unit 219 may display on the display unit 29 that generation of the test group ID and storing of the test group ID in the electronic control unit 1 to be assembled have been completed.

The writing device 2 has publicly known unwritten VIN prevention function and erroneous write prevention function. In this manner, the contents of VIN information written to the electronic control unit 1 by the writing device 2 are guaranteed. Other functions of the writing device 2 are publicly known, and thus a detailed description is omitted.

[Diagnostic Device 3]

Figure 6:
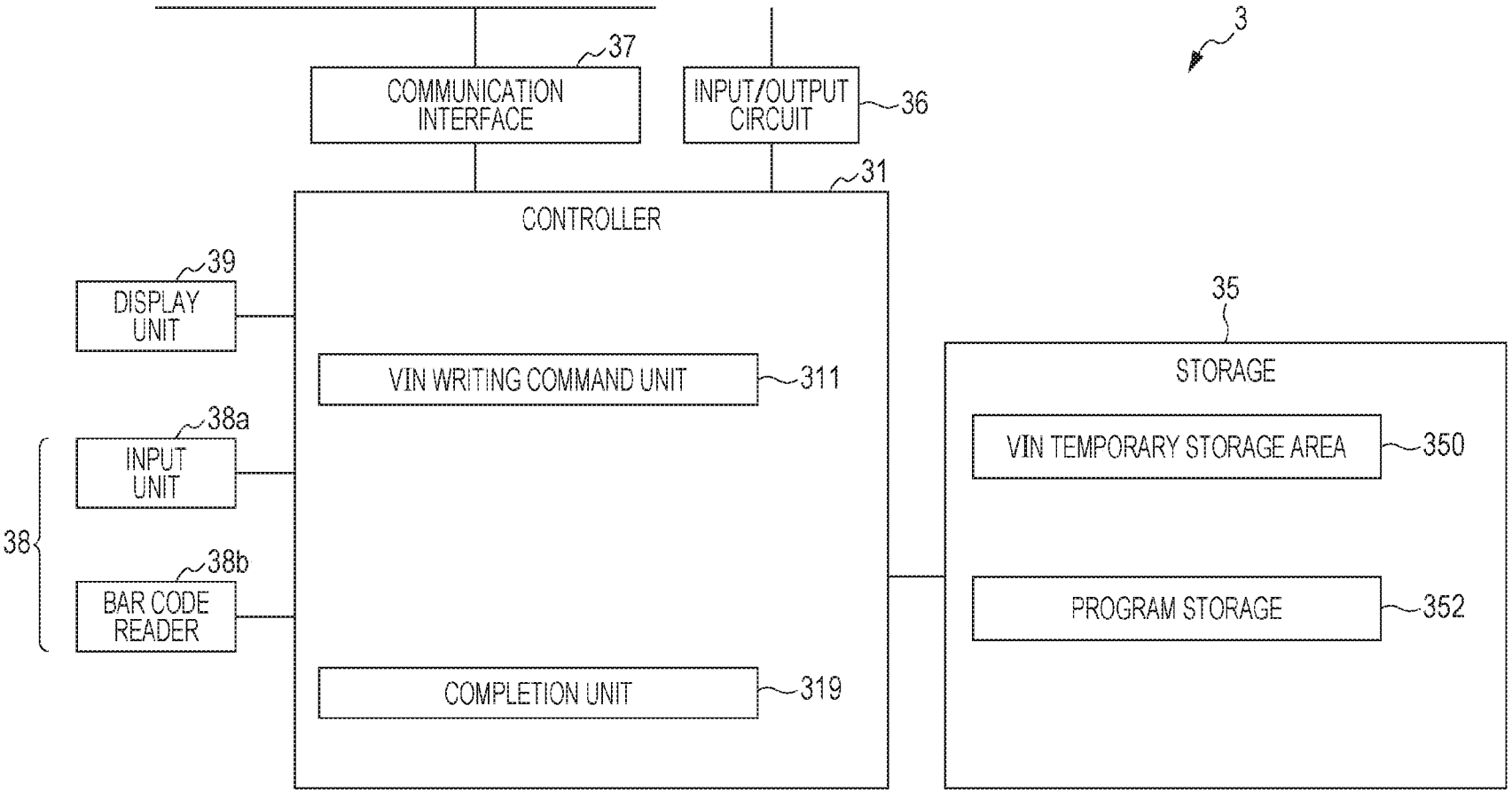
FIG. 6 is a diagram illustrating the configuration of a diagnostic device.

The basic configuration of the diagnostic device 3 is illustrated in FIG. 6. As illustrated in FIG. 6, similarly to the writing device 2 described above, the diagnostic device 3 includes a controller 31 including a CPU, a storage 35 having a ROM, a RAM, and an EEPROM, an input/output circuit 36 for inputting various sensor signals and outputting various control signals, a communication interface 37 for the electronic control unit 1, an input unit 38 for inputting an instruction by an operator, and a display unit 39 for displaying a processing result or the like. Also, the diagnostic device 3 performs control related to the writing device 2 based on an instruction by an operator, and communication data transmitted and received to and from the electronic control unit 1.

[Function of Diagnostic Device 3]

As illustrated in FIG. 6, in the diagnostic device 3, the storage 35 includes a VIN temporary storage area 350, and a program storage 352, and the diagnostic device 3 functions as a VIN write command unit 311 and a completion unit 319 by executing programs stored in the program storage 352 by the controller 31.

When an electronic control unit 1 is replaced due to a cause such as a fault, a worker who performs replacement work of the electronic control unit 1 manually inputs the VIN to the VIN temporary storage area 350 of a new electronic control unit 1 via the VIN write command unit 311, for instance. When the diagnostic device 3 has a bar code reading function, the VIN write command unit 311 may store the VIN read from a label of the vehicle in the VIN temporary storage area 350. Alternatively, the VIN write command unit 311 may read the VIN of the vehicle from the VIN storage area 150 of the electronic control unit 1 to be replaced, and may store the VIN in the VIN temporary storage area 350.

When receiving a completion notification for test group ID generation from the new electronic control unit 1, in response to the completion notification, the completion unit 319 may display on the display unit 39 that incorporation of the Test group ID into the replacing electronic control unit 1 (new electronic control unit 1) has been completed.

Similarly to the writing device 2, the diagnostic device 3 has the unwritten VIN prevention function and the erroneous write prevention function. In this manner, the contents of VIN information written to the electronic control unit 1 are guaranteed. The fault diagnosis function, the fault history management function, and other functions of the diagnostic device 3 are publicly known, and thus a detailed description is omitted.

(Operation of Test Group Identification Information Automatic Generation System 1000)

Figure 7A:
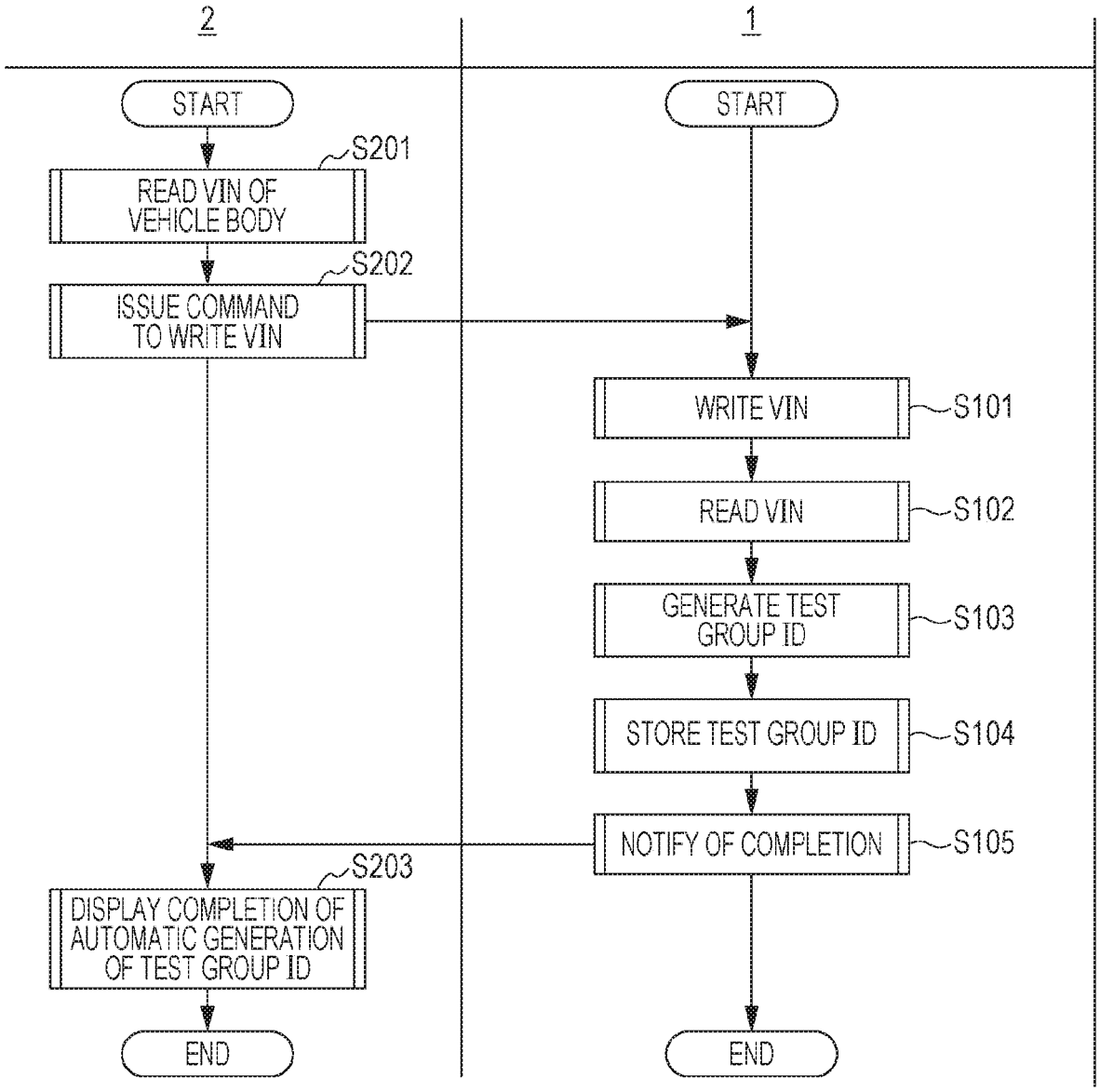
FIG. 7A is a flowchart illustrating the flow of processing of the test group identification information automatic generation system.
Figure 7B:
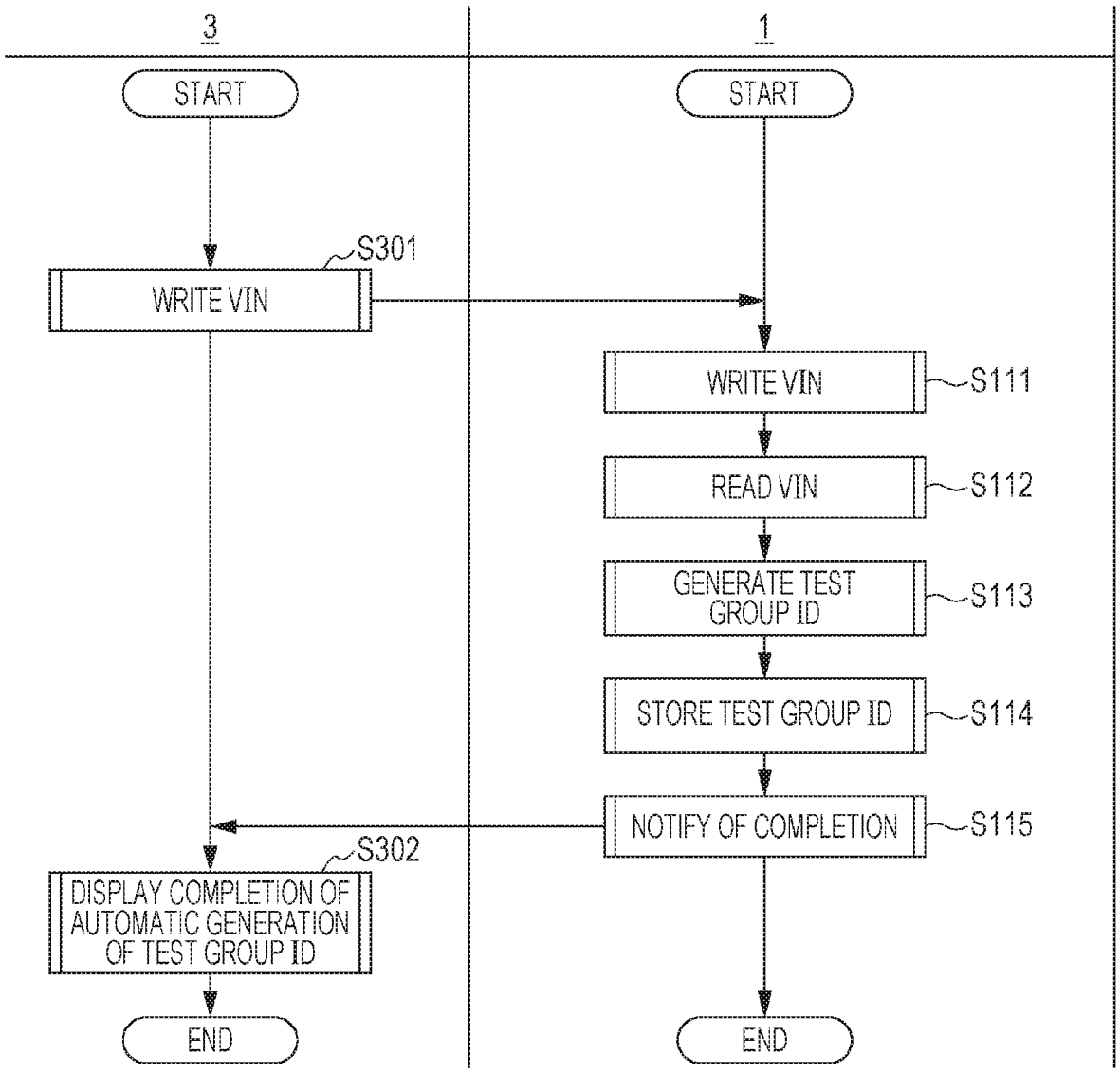
FIG. 7B is a flowchart illustrating the flow of processing of the test group identification information automatic generation system.

The configuration of the test group identification information automatic generation system 1000 has been described above. Next, the operation of the test group identification information automatic generation system 1000 will be described. FIGS. 7A to 7B are flowcharts illustrating the flow of the processing of the test group identification information automatic generation system 1000.

First, referring to FIG. 7A, the operation related to generation of test group identification information at the time of production (for instance, an assembly process in which the engine is installed in the vehicle body) of finished vehicles will be described. Here, the processing steps performed by the electronic control unit 1, the processing steps performed by the writing device, and the processing steps performed by the diagnostic device are labeled with a 3-digit number with 1, 2, and 3, respectively in hundreds place, and thus the processing steps of the unit and devices are distinguished from each other.

It is assumed that before generation processing for test group identification information is performed at the time of production (for instance, an assembly process in which the engine is installed in the vehicle body) of finished vehicles, in the electronic control unit 1, the VIN storage area 150 and the test group ID storage area 151 are pre-set in the storage 15 (for instance, an EEPROM), and a program for test group ID automatic generation is pre-stored in the program storage 152.

First, the processing of the writing device 2 is started.

In step S201, the writing device 2 (the VIN write command unit 211) reads the VIN of the vehicle body, for instance, from a label by the bar code reader 28*b*, and stores the read VIN in the VIN temporary storage area 250.

In step S202, the writing device 2 (the VIN write command unit 211) reads the VIN stored in the VIN temporary storage area 250 in step S201, and transmits a write command for the VIN to the electronic control unit 1.

(Processing of Electronic Control Unit 1)

In step S101, in response to the write command for the VIN received from the writing device 2, the controller 11 (the VIN writing unit 110) stores the VIN in the VIN storage area 150, and sets the VIN storage area 150 to a VIN write completion state resulting in a data writing prohibited area.

In step S102, in response to storing of the VIN in the VIN storage area 150 in step S101, the controller 11 (the VIN reading unit 111) reads the VIN stored in the VIN storage area 150.

In step S103, the controller 11 (the test group ID generation unit 112) determines, and generates a test group ID by checking the VIN information read in step S102 against the fixed parameter values provided in the program for test group ID automatic generation.

In step S104, the controller 11 (the test group ID storing unit 113) stores the test group ID generated in step S103 in the storage 15 (the test group ID storage area 151), and sets the test group ID storage area 151 to a test group ID write completion state resulting in a data writing prohibited area.

In step S105, the controller 11 (the completion unit 119) notifies the writing device 2 that generation of a test group ID and storing of the test group ID in the test group ID storage area 151 have been completed, and completes the test group ID automatic generation function.

(Processing of Writing Device 2)

In step S203, in response to the completion notification for test group ID generation received from the electronic control unit 1, the writing device 2 (the completion unit 219) displays on the display unit 29 that generation of the test group ID and storing of the test group ID in the electronic control unit 1 to be assembled have been completed.

FIG. 7B is a flowchart illustrating the flow of the processing of the test group identification information automatic generation system 1000 at the time of replacement of an electronic control unit 1 due to a cause such as a fault after vehicles come on the market.

It is assumed that before generation processing for test group identification information is performed at the time of replacement of an electronic control unit 1, in a new electronic control unit 1 (hereinafter simply referred to as the "electronic control unit 1") newly incorporated to replace a faulty electronic control unit 1, the VIN storage area 150 and the test group ID storage area 151 are pre-set in the storage 15 (for instance, an EEPROM), and a program for test group ID automatic generation is pre-stored in the program storage 152.

The processing of the test group identification information automatic generation system 1000 at the time of replacement of an electronic control unit 1 is as follows.

Referring to FIG. 7B, in step S301, VIN is stored in the VIN temporary storage area 350 of the new electronic control unit 1 (for instance, manually via the diagnostic device) by a worker who performs replacement work of the electronic control unit 1. Alternatively, the diagnostic device 3 (the VIN write command unit 311) having a bar code reading function may store the VIN read from a label of the vehicle in the VIN temporary storage area 350.

Alternatively, the VIN of the vehicle may be read from the VIN storage area 150 of the electronic control unit 1 to be replaced, and stored in the VIN temporary storage area 350 of a new electronic control unit 1 by the diagnostic device 3 (the VIN write command unit 311).

It is to be noted that the processing of the diagnostic device in step S302 is the same as the above-described processing of the writing device 2 in step S203, in which the writing device 2 is replaced by the diagnostic device 3, and a detailed description is omitted.

Also, the processing of the electronic control unit 1 in step S111 to step S115 is the same as the above-described processing of the electronic control unit 1 in step S101 to step S105, in which the writing device 2 is replaced by the diagnostic device 3, and a detailed description is omitted.

Since the first embodiment is configured as described above, in management of a test group ID (or an engine family number) of the vehicle, the test group ID (or the engine family number) can be generated more easily and more reliably and be stored in an ECU mounted in the vehicle.

More specifically, when a test group ID is generated, a storage area and information (data and programs) to be stored are utilized, which are pre-set in an electronic control unit mounted in the vehicle by an ECU supplier or an electronic control unit manufacturing department.

Consequently, test group ID preparation work by workers is reduced at the time of production (for instance, an assembly process in which the engine is installed in the vehicle body) of finished vehicles. Also, the burden of workers can be reduced at the time of production (for instance, an assembly process in which the engine is installed in the vehicle body) of finished vehicles. Also, since manual transcription can be omitted, man-made mistakes or risk can be eliminated.

In addition, the test group ID is automatically generated in the electronic control unit, and thus the possibility of intentional falsification can be eliminated and man-made mistakes can be prevented.

Furthermore, even when an electronic control unit 1 is replaced due to a cause such as a fault after vehicles come on the market, the test group ID is automatically calculated using the VIN which is obtained by reading from a label of the vehicle by a worker who performs replacement work of the electronic control unit 1 or by reading from the VIN storage area 150 of the electronic control unit 1 to be replaced by the diagnostic device 3 (the VIN write command unit 311) having a bar code reading function, and thus the possibility of intentional falsification can be eliminated and man-made mistakes can be prevented.

[Second Embodiment]

In the first embodiment, a program for test group ID automatic generation is pre-stored in the program storage 152 of the electronic control unit 1.

In contrast, in the second embodiment, the management server 4 is included, and instead of the electronic control unit 1, the management server 4 includes a program for test group ID automatic generation and a comparison table (table). In this manner, the management server 4 (the controller 41) causes the management server 4 to function as a predetermined unit (test group ID automatic generation unit) by executing the program for test group ID automatic generation.

Here, the comparison table is data stored in a database related to conversion between Christian year and model year, and is referred to at the time of VIN generation.

Also, conversion between vehicle model number and vehicle category, engine displacement, emission control category may be stored as the data in a database in the form of another comparison table. The form of any of these comparison tables is not limited to a tabular form (table).

Hereinafter, in the second embodiment, a point of difference from the first embodiment will be mainly described, and a detailed description for the same configuration as that of the first embodiment is omitted. The description of the first embodiment is applied as appropriate to the points not particularly described in the second embodiment. Also, in the second embodiment, the same effect as that of the first embodiment is achieved.

Figure 8:
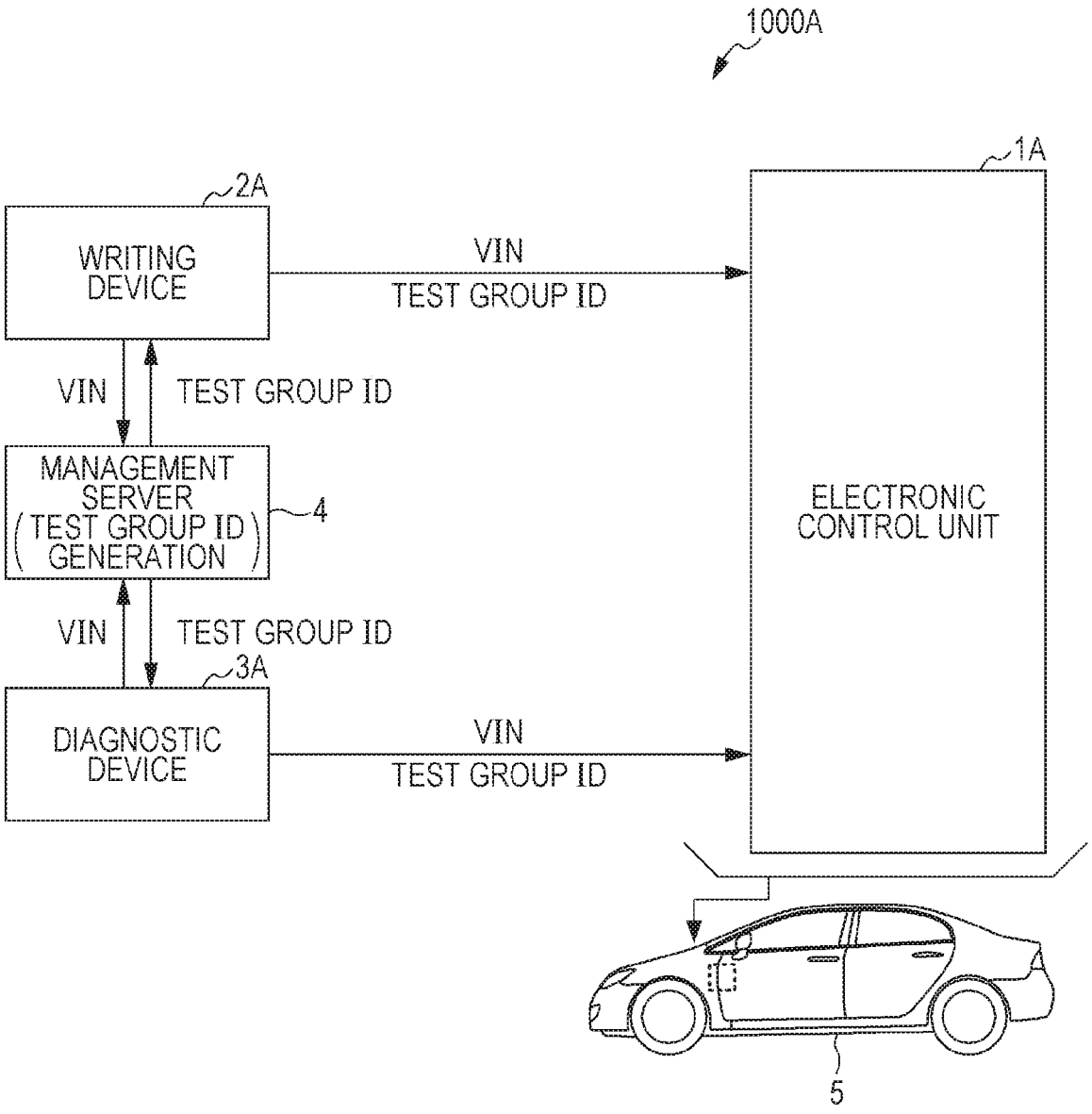
FIG. 8 is a diagram illustrating the system configuration of a test group identification information automatic generation system according to a second embodiment.

As illustrated in FIG. 8, the test group identification information automatic generation system 1000A according to the second embodiment includes an electronic control unit 1A, a writing device 2A, a diagnostic device 3A, the management server 4, and the vehicle 5.

[Electronic Control Unit 1A]

Figure 9:
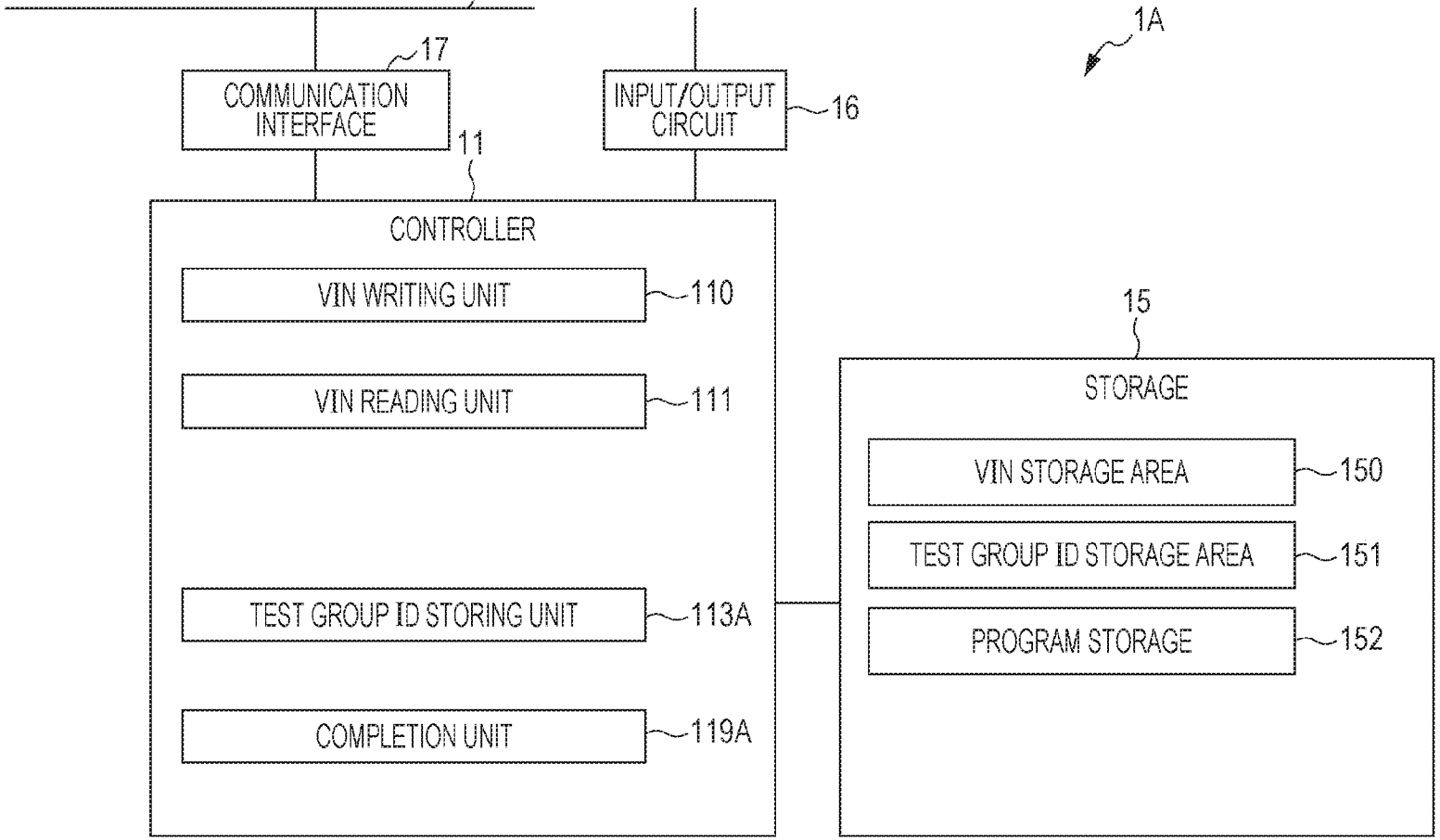
FIG. 9 is a functional block diagram illustrating the functional configuration of an electronic control unit according to the second embodiment.

The functional configuration of the electronic control unit 1A is illustrated in FIG. 9. The controller 11 (the CPU 11) causes the controller 11 (the CPU 11) to function as the VIN writing unit 110, the VIN reading unit 111, a test group ID storing unit 113A, and a completion unit 119A by executing programs (hereinafter also collectively referred to as the "test group ID storing program").

The VIN writing unit 110 and the VIN reading unit 111 are the same as those described in the first embodiment.

In response to a write command for a test group ID from the writing device 2 or the diagnostic device 3, the test group ID storing unit 113A stores the test group ID in the test group ID storage area 151, and sets the test group ID storage area 151 to a test group ID write completion state resulting in a data writing prohibited area.

In response to storing of the test group ID in the test group ID storage area 151, the completion unit 119A notifies the writing device 2 or the diagnostic device 3 that storing of the test group ID in the test group ID storage area 151 has been completed.

Also, as illustrated in FIG. 9, the storage 15 includes the VIN storage area 150, the test group ID storage area 151, and the program storage 152 including the test group ID storing program.

[Writing Device 2A]

Figure 10:
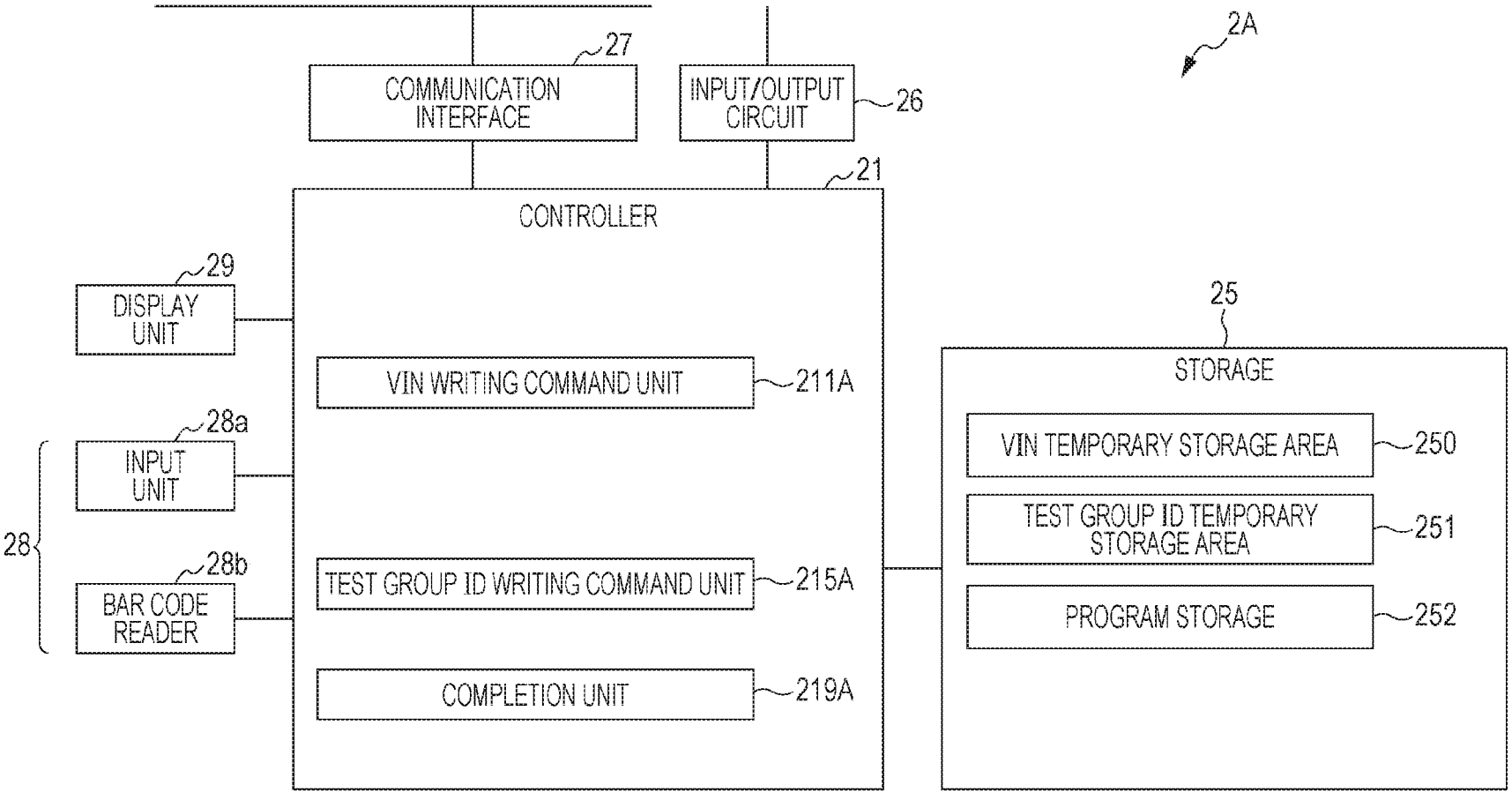
FIG. 10 is a diagram illustrating the configuration of a writing device.

The functional configuration of the writing device 2A is illustrated in FIG. 10. The writing device 2A also performs data communication with the management server 4 via the communication interface 27.

[Function of Writing Device 2A]

As illustrated in FIG. 10, the writing device 2A includes the VIN temporary storage area 250, the test group ID temporary storage area 251, and the program storage 252 in the storage 25, and causes the writing device 2A to function as a VIN write command unit 211A, a test group ID write command unit 215A, and a completion unit 219A by executing a predetermined program by the controller 21.

The VIN write command unit 211A has the function of the VIN write command unit 211 in the first embodiment as well as a function of transmitting the VIN stored in the VIN temporary storage area 250 to the management server 4.

When receiving the test group ID generated by the management server 4, the test group ID write command unit 215A stores the test group ID in the test group ID temporary storage area 251, and subsequently transmits a write command for the test group ID stored in the test group ID temporary storage area 251 to the electronic control unit 1A via the communication interface 27. In this manner, the test group ID write command unit 215A stores the test group ID generated by the management server 4 in the storage area of the electronic control unit 1A.

The completion unit 219A has the function of the completion unit 219 in the first embodiment as well as a function of transmitting a completion notification for storing of the test group ID to the management server 4 after receiving the notification from the electronic control unit 1A.

[Diagnostic Device 3A]

Figure 11:
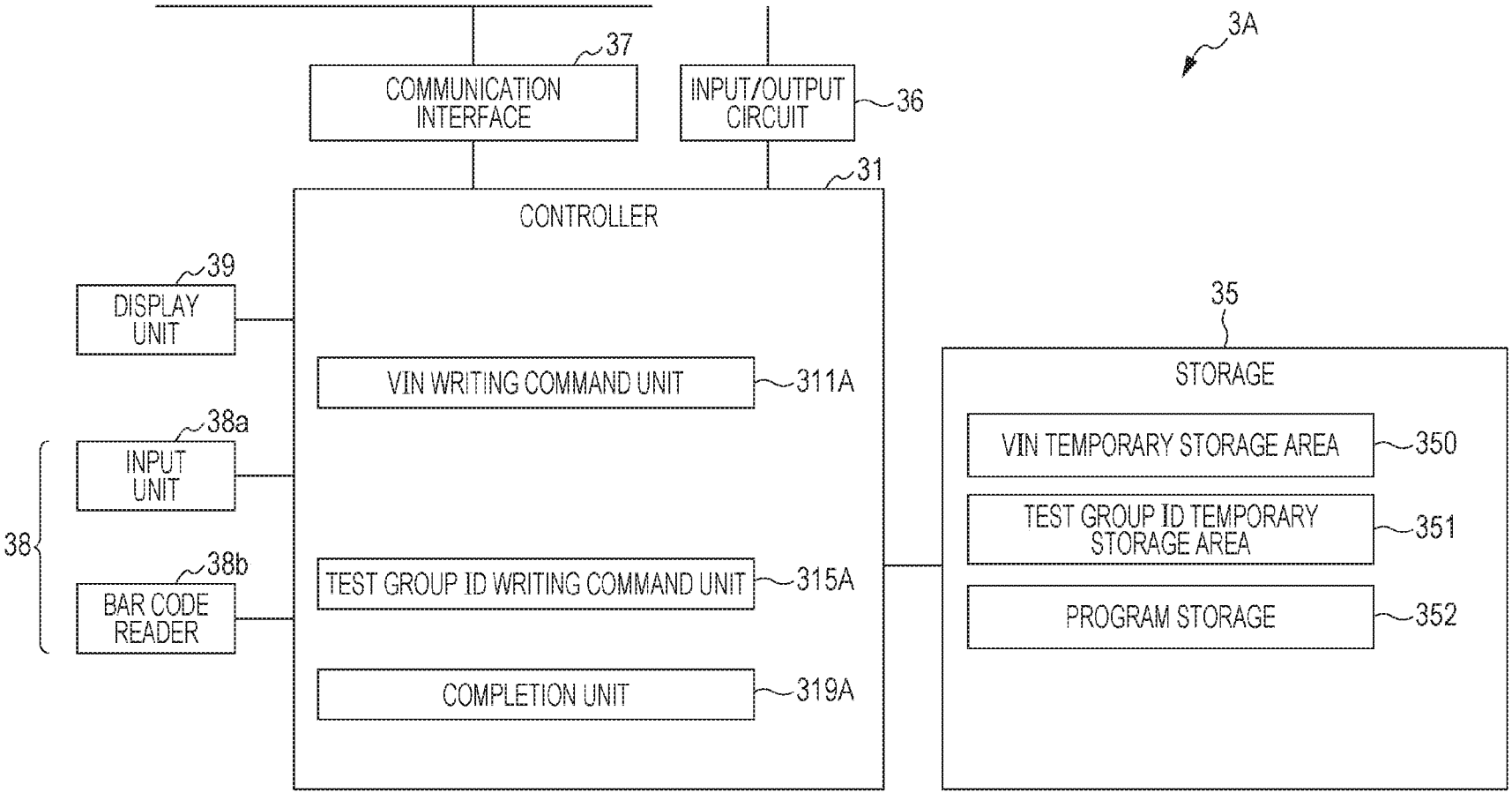
FIG. 11 is a diagram illustrating the configuration of a diagnostic device.

The functional configuration of the diagnostic device 3A is illustrated in FIG. 11. Similarly to the writing device 2A, the diagnostic device 3A performs data communication with the management server 4 via the communication interface 37.

[Function of Diagnostic Device 3A]

As illustrated in FIG. 11, the diagnostic device 3A includes the VIN temporary storage area 350 a test group ID temporary storage area 351, and the program storage 352 in the storage 35, and causes the diagnostic device 3A to function as a VIN write command unit 311A, a test group ID write command unit 315A, and a completion unit 319A by executing a predetermined program by the controller 31.

The VIN write command unit 311A has the function of the VIN write command unit 311 in the first embodiment as well as a function of transmitting the VIN stored in the VIN temporary storage area 350 to the management server 4.

When receiving the test group ID generated by the management server 4, the test group ID write command unit 315A stores the test group ID in the test group ID temporary storage area 351, and subsequently transmits a write command for the test group ID stored in the test group ID temporary storage area 351 to the new electronic control unit 1A via the communication interface 37. In this manner, the test group ID write command unit 315A stores the test group ID generated by the management server 4 in the storage area of a new electronic control unit 1A which has been prepared beforehand.

In addition to the function of the completion unit 319 in the first embodiment, the completion unit 319A has a function of transmitting a completion notification for storing of the test group ID to the management server 4 after receiving the notification from the new electronic control unit 1A.

[Management Server 4]

Next, the management server 4 will be described.

Figure 12:
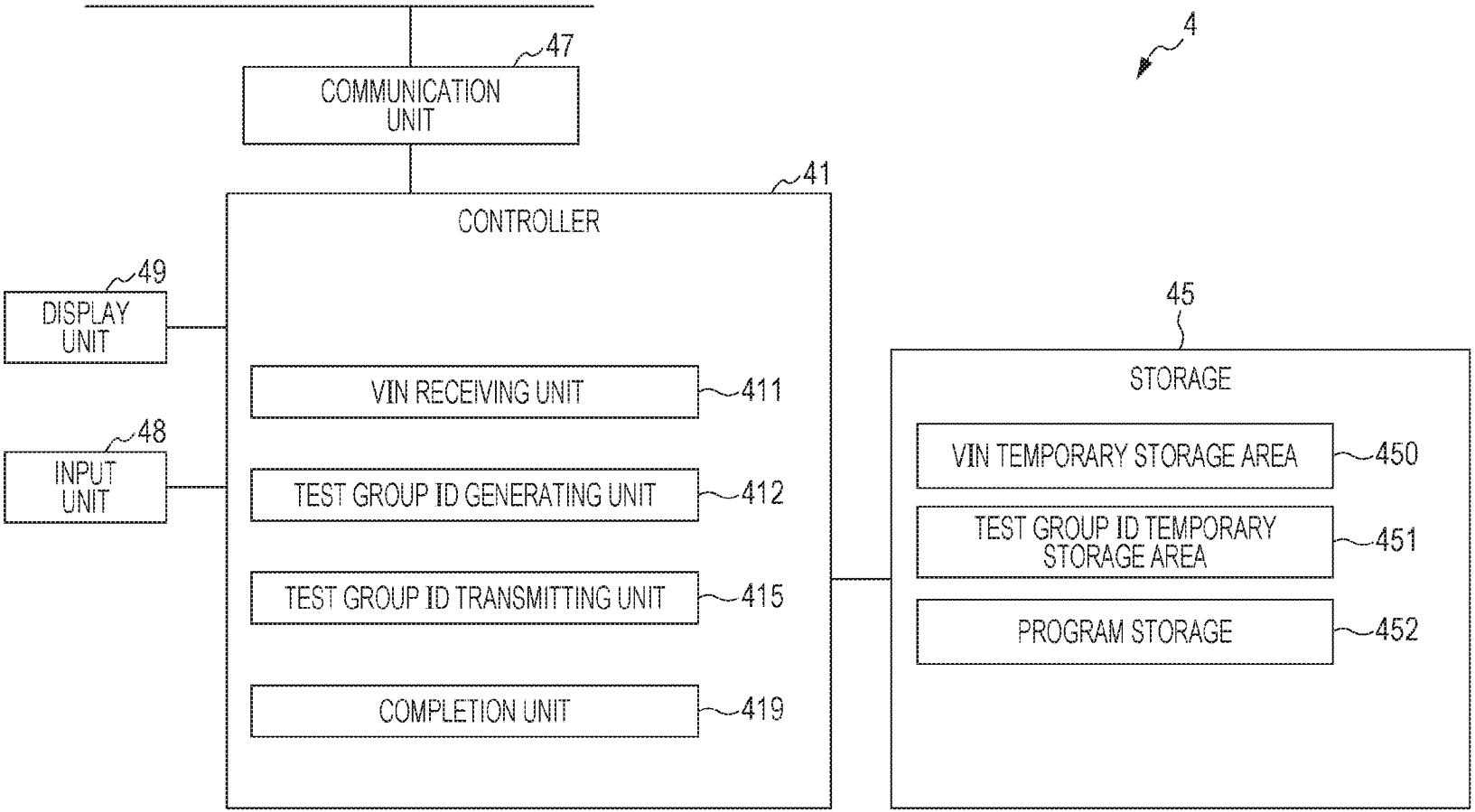
FIG. 12 is a functional block diagram indicating the functional configuration of a management server according to the second embodiment.

As illustrated in FIG. 12, the management server 4 includes at least a controller 41, a storage 45, and a communication unit 47, and may further include an input unit 48 and a display unit 49 as appropriate. Although in the second embodiment, description is provided using a single server, the second embodiment may be implemented by a distributed server called a cloud server (including a virtual server) which includes different servers for every functions.

The controller 41 includes a processor having a CPU, and controls the component units. The CPU executes each program for test group ID automatic generation read from the storage 45, and at the time of execution, The CPU reads information from the storage 45, writes information to the storage 45, and performs data communication with the writing device 2A or the diagnostic device 3A via the communication unit 47. The details will be described later.

The storage 45 includes, for instance, a semiconductor memory and a hard disk drive. Various types of information are stored in the storage 45, such as software called an operating system (OS) or an application.

The storage 45 includes a VIN temporary storage area 450, a test group ID temporary storage area 451, and a program storage 452 including programs for test group ID automatic generation.

The programs for test group ID automatic generation are pre-stored in the program storage 452, for instance, by an ECU supplier or an electronic control unit manufacturing department.

Similarly to the first embodiment, a vehicle category and an emission control category corresponding to the attribute (vehicle model number) of the vehicle are provided as fixed parameter values in the program for test group ID automatic generation.

Next, the function of the controller 41 will be described. The controller 41 (the CPU 11) causes the management server 4 to function as predetermined functional units (hereinafter, collectively referred to as the "test group ID automatic generation unit") by executing the programs for test group ID automatic generation.

As illustrated in FIG. 12, the controller 41 includes a VIN receiving unit 411, a test group ID generation unit 412, a test group ID transmitting unit 415, and a completion unit 419.

The VIN receiving unit 411 receives VIN from the writing device 2A or the diagnostic device 3A, and stores the VIN in the VIN temporary storage area 450.

The test group ID generation unit 412 receives the VIN from the VIN receiving unit 411, and in response to storing in the VIN temporary storage area 450, and determines and generates a test group ID based on the VIN information. The test group ID generation unit 412 stores the generated test group ID in the test group ID temporary storage area 451. When fixed parameter values are provided in the program for test group ID automatic generation, the test group ID generation unit 412 determines, and generates a test group ID by checking the VIN information received from the VIN receiving unit 411 against the fixed parameter values provided in the program for test group ID automatic generation.

In response to storing of the test group ID generated by the test group ID generation unit 412 in the test group ID temporary storage area 451, the test group ID transmitting unit 415 transmits the generated test group ID to the writing device 2A or the diagnostic device 3A. It is to be noted that the test group ID may be transferred from the test group ID generation unit 412 to the test group ID transmitting unit 415, for instance, by interprocess communication.

When receiving a completion notification for storing of a test group ID in the electronic control unit 1A from the writing device 2A or the diagnostic device 3A, the completion unit 419 completes the test group ID automatic generation function.

The completion unit 419 may display on the display unit 49 of the management server 4 that storing of the test group ID in an electronic control unit 1A to be replaced or a replacing electronic control unit 1A (new electronic control unit 1A) has been completed.

(Operation of Test Group Identification Information Automatic Generation System 1000A)

The configuration of the test group identification information automatic generation system 1000A has been described above. Next, the operation of the test group identification information automatic generation system 1000A will be described. FIGS. 13A to 13D are each a flowchart illustrating the flow of processing of the test group identification information automatic generation system 1000A. It is assumed that a comparison table between Christian year and a numeral or character of model year is pre-stored in the storage 45 of the management server 4, and programs for test group ID automatic generation are pre-stored in the program storage 552. The form of the comparison table is not limited to a tabular form, and the comparison table may be information that provides values of conversion.

Alternatively, correspondence between vehicle attribute (vehicle model number), vehicle category, and emission control category may be included in information such as a table.

First, referring to FIGS. 13A and 13B, the processing flow for generation of test group identification information at the time of replacement of an electronic control unit 1A due to a cause such as a fault after vehicles come on the market will be described.

Figure 13A:
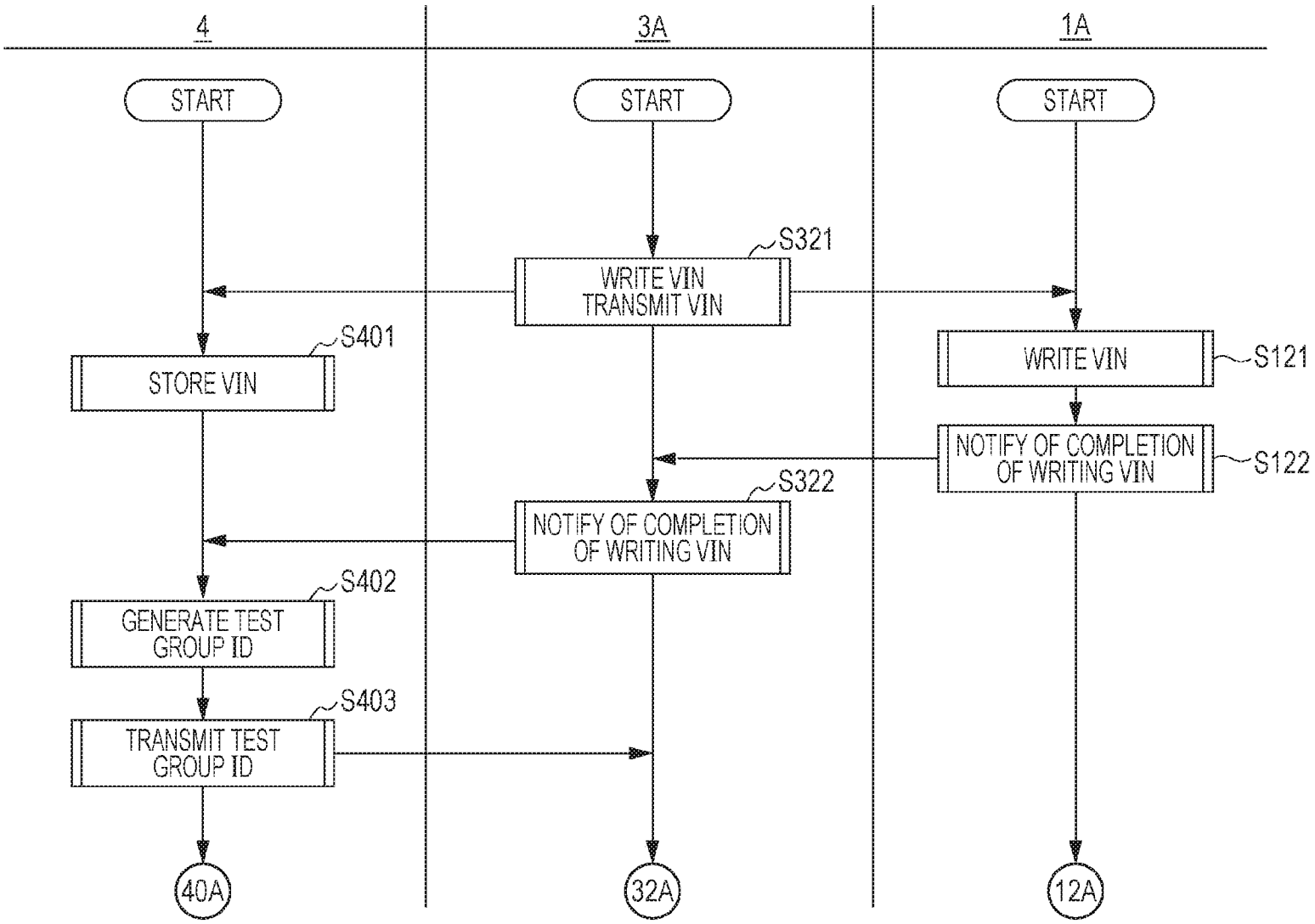
FIG. 13A is a flowchart illustrating the flow of processing of a test group identification information automatic generation system.
Figure 13B:
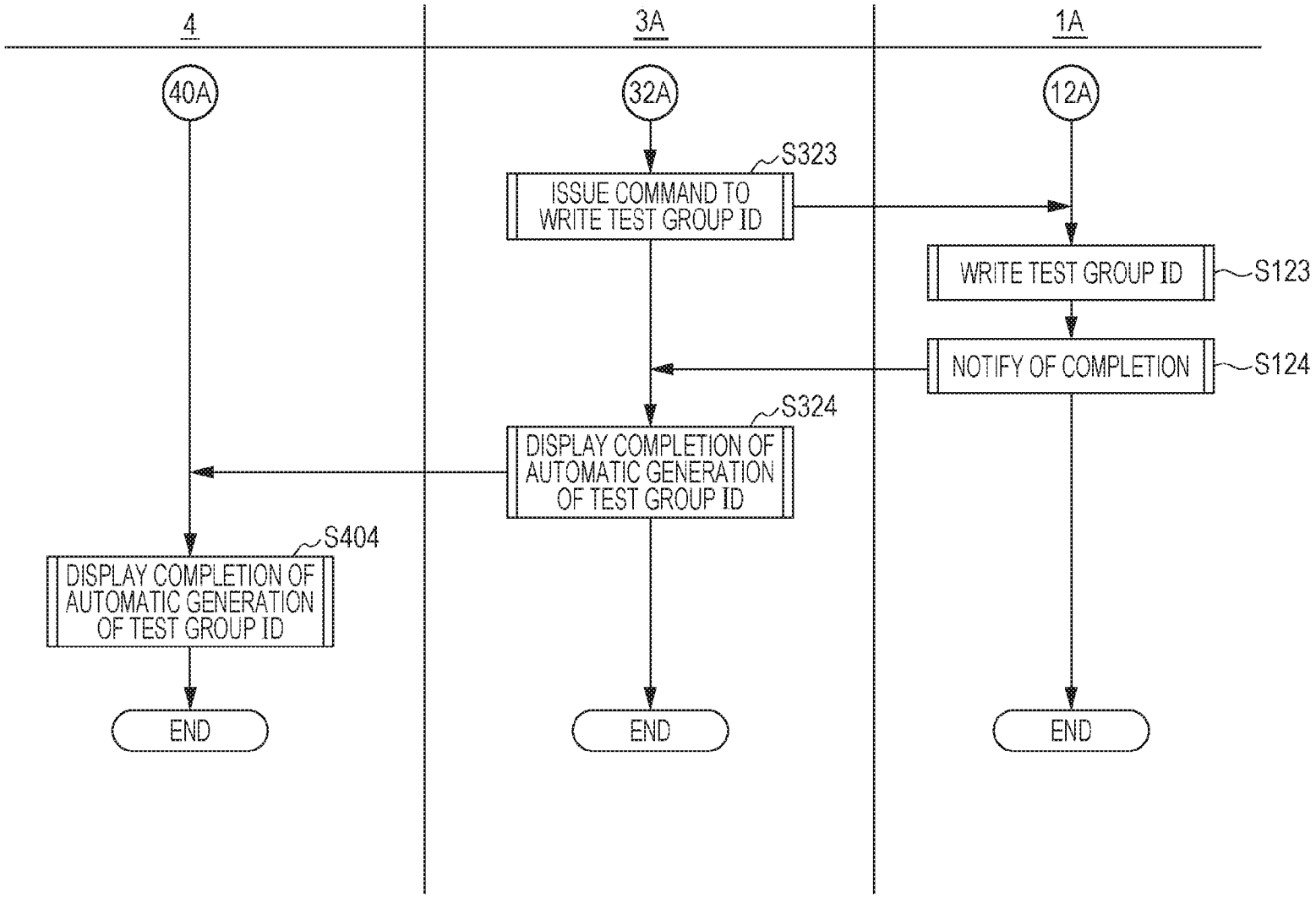
FIG. 13B is a flowchart illustrating the flow of processing of the test group identification information automatic generation system.

Referring to FIG. 13A, first, the processing of the diagnostic device 3A is started.

In step S321, VIN is transmitted to a new electronic control unit 1 (for instance, manually via the diagnostic device 3A) by a worker who performs replacement work of the electronic control unit 1A. At this point, the diagnostic device 3A (the VIN write command unit 311A) transmits VIN to the management server 4.

(Processing of Management Server 4)

In step S401, the management server 4 (VIN receiving unit 411) stores the VIN received from the diagnostic device 3A in the VIN temporary storage area 450.

(Processing of Electronic Control Unit 1A)

In step S121, in response to a write command received from the diagnostic device 3A, the electronic control unit 1A (the VIN writing unit 110) stores the VIN in the VIN storage area 150, and sets the VIN storage area 150 to a VIN write completion state resulting in a data writing prohibited area.

In step S122, the electronic control unit 1A (VIN writing unit 110) transmits a completion notification for VIN writing to the diagnostic device 3A.

(Processing of Diagnostic Device 3A)

In step S322, the diagnostic device 3A (the VIN write command unit 311A) transmits the completion notification for VIN writing to the management server 4.

(Processing of Management Server 4)

In step S402, in response to the completion notification for VIN writing received from the diagnostic device 3A as a trigger, the management server 4 (the test group ID generation unit 412) determines and generates a test group ID based on the VIN information, and stores the generated test group ID in the test group ID temporary storage area 451. Like this, the test group ID generation unit 412 is preferably started-up triggered by the completion notification for VIN writing. In step S403, in response to storing of the test group ID in the test group ID temporary storage area 451 in step S402, the management server 4 (the test group ID transmitting unit 415) transmits the generated test group ID to the diagnostic device 3A.

(Processing of Diagnostic Device 3A)

In step S323, the diagnostic device 3A (the test group ID write command unit 315A) stores the test group ID received from the management server 4 in the test group ID temporary storage area 351, and transmits a write command for the test group ID to the electronic control unit 1A via the communication interface 27.

(Processing of Electronic Control Unit 1A)

In step S123, in response to the write command for the test group ID received from the diagnostic device 3A, the electronic control unit 1A (the test group ID storing unit 113A) stores the test group ID in the storage 15 (the test group ID storage area 151), and sets the test group ID storage area 151 to a test group ID write completion state resulting in a data writing prohibited area.

In step S124, in response to storing of the test group ID in the storage 15 (the test group ID storage area 151), the electronic control unit 1A (the completion unit 119A) notifies the diagnostic device 3 that storing of the test group ID in the test group ID storage area 151 has been completed.

(Processing of Diagnostic Device 3A)

In step S324, in response to the completion notification for storing of the test group ID, received from the electronic control unit 1A, the diagnostic device 3A (the completion unit 319A) transmits the completion notification for storing of the test group ID to the management server 4. The diagnostic device 3A may display on the display unit 39 that storing of the test group ID in the replacing electronic control unit 1A (new electronic control unit 1A) has been completed.

(Processing of Management Server 4)

In step S404, in response to the completion notification for storing of the test group ID in the electronic control unit 1A, received from the diagnostic device 3A, the management server 4 (the completion unit 419) completes the test group ID automatic generation function. The management server 4 may display on the display unit 49 of the management server 4 that storing of the test group ID in the replacing electronic control unit 1A (new electronic control unit 1A) has been completed.

Figure 13C:
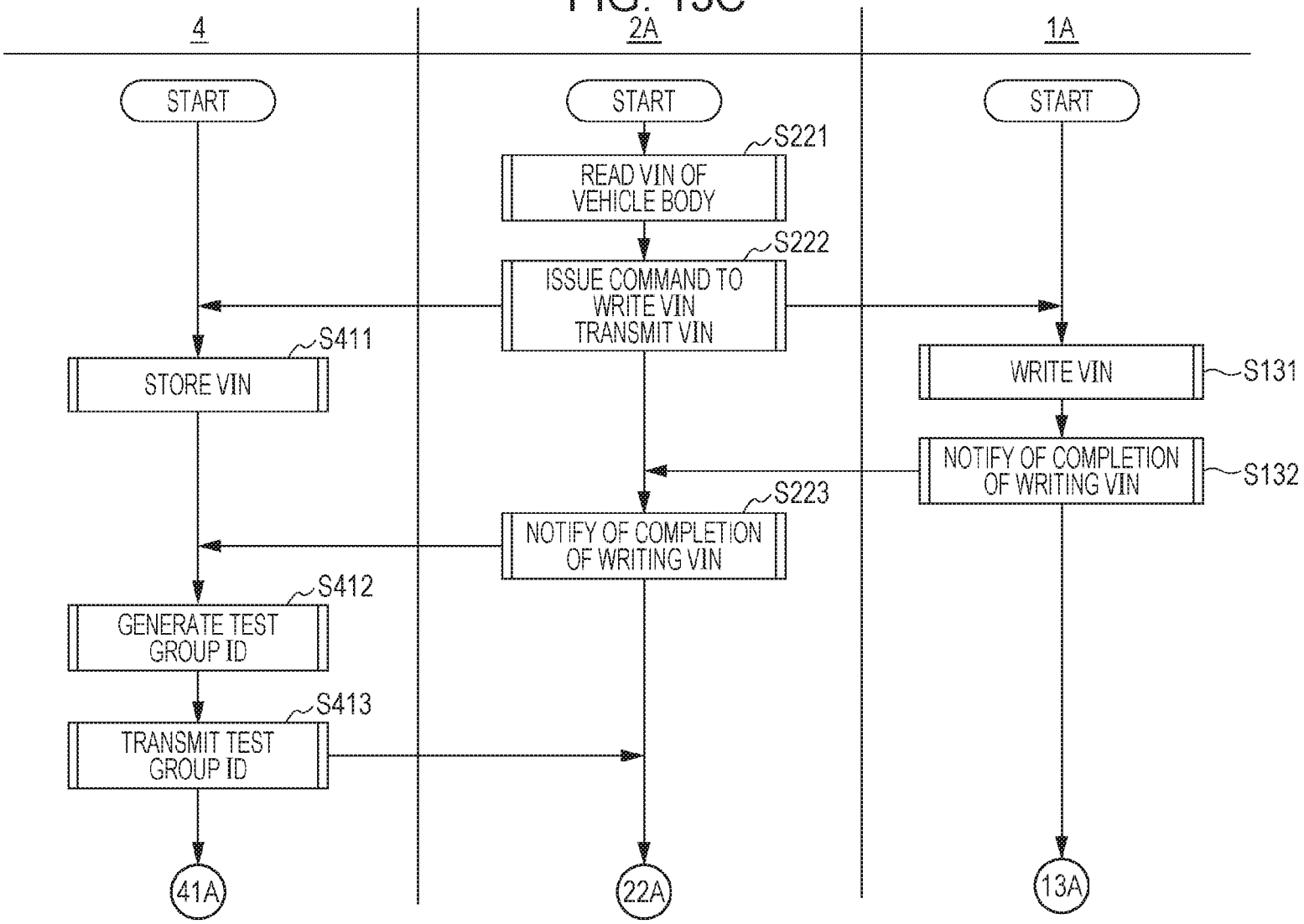
FIG. 13C is a flowchart illustrating the flow of processing of the test group identification information automatic generation system.
Figure 13D:
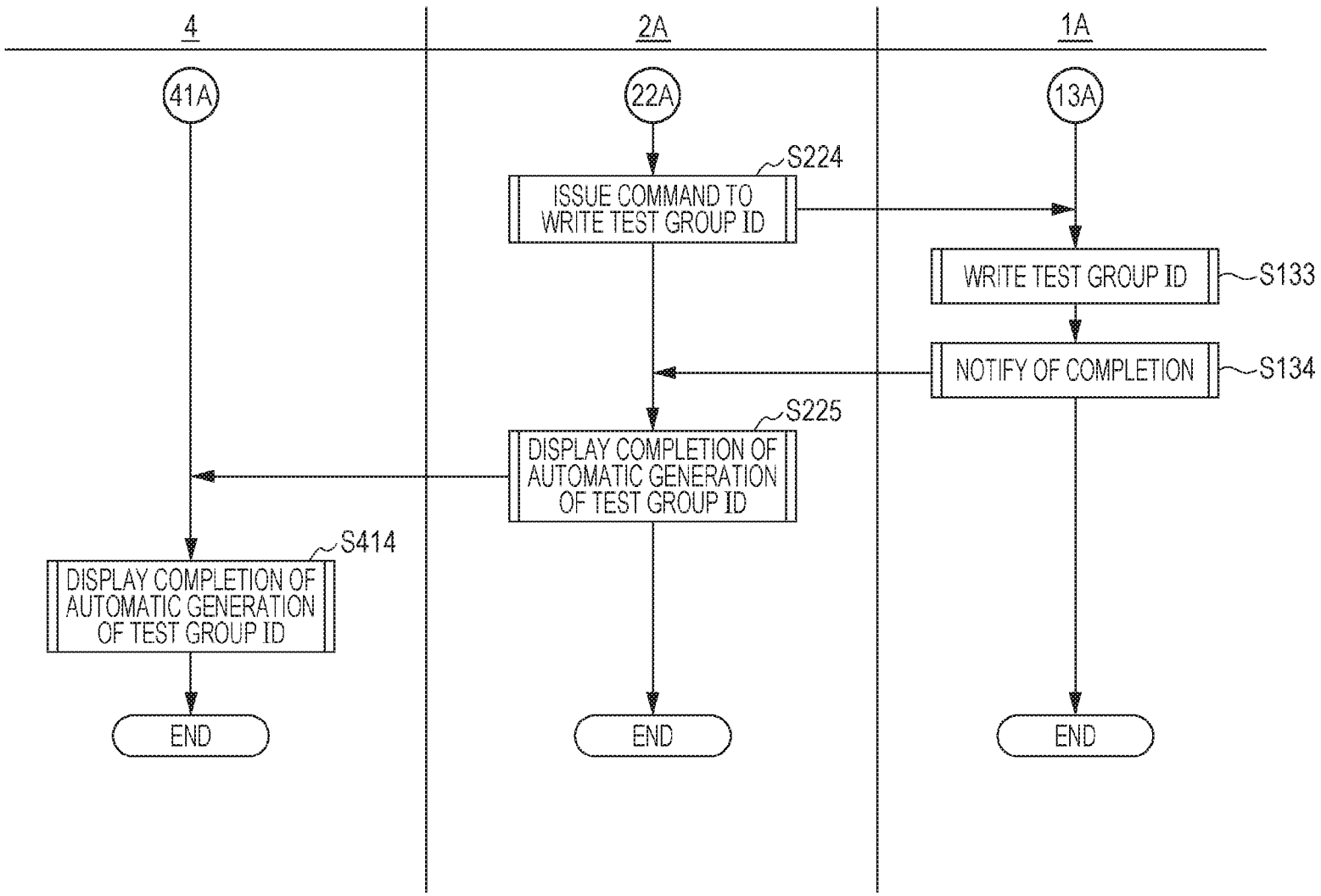
FIG. 13D is a flowchart illustrating the flow of processing of the test group identification information automatic generation system.

Next, FIGS. 13C and 13D are each a flowchart illustrating the flow of the processing of the test group identification information automatic generation system 1000A at the time of production (for instance, an assembly process in which the engine is installed in the vehicle body) of finished vehicles.

Referring to FIG. 13C, in step S221, the writing device 2A (the VIN write command unit 211A) reads the VIN of the vehicle body, for instance, from a label by the bar code reader 28*b*, and stores the read VIN in the VIN temporary storage area 250.

Also, the processing of the writing device 2A in step S222 to step S225 is the same as the above-described processing of the diagnostic device 3A in step S311 to step S324, in which the diagnostic device 3 is replaced by the writing device 2, and a detailed description is omitted.

Also, the processing of the electronic control unit 1A in step S131 to step S134 is the same as the above-described processing of the electronic control unit 1A in step S121 to step S124, in which the diagnostic device 3A is replaced by the writing device 2A, and a detailed description is omitted.

Similarly, the processing of the management server 4 in step S411 to step S414 is the same as the above-described processing of the management server 4 in step S401 to step S404, in which the diagnostic device 3A is replaced by the writing device 2A, and a detailed description is omitted.

Since the second embodiment is configured as described above, the same effect as that of the first embodiment can be achieved.

Also, the programs for test group ID automatic generation can be managed in a unified manner by the management server 4, thereby providing more efficient management related to maintenance of the programs for test group ID automatic generation.

[Third Embodiment]

In the second embodiment, a program for test group ID automatic generation is pre-stored in the program storage 452 of the management server 4.

In a third embodiment, the writing device or the diagnostic device includes a program for test group ID automatic generation. In this manner, the writing device or the diagnostic device causes the writing device or the diagnostic device to function as a predetermined unit (test group ID automatic generation unit) by executing the program for test group ID automatic generation.

Similarly to the second embodiment, the third embodiment may include a management server. However, the management server manages, for instance, the latest comparison table and provides the comparison table to the writing device or the diagnostic device as appropriate, and a detailed description is omitted.

Hereinafter, in the third embodiment, a point of difference from the first embodiment or the second embodiment will be mainly described, and a detailed description for the same configuration as that of the first embodiment or the second embodiment is omitted. The description of the first embodiment or the second embodiment is applied as appropriate to the points not particularly described in the third embodiment. Also, in the third embodiment, the same effect as that of the first embodiment is achieved.

Figure 14:
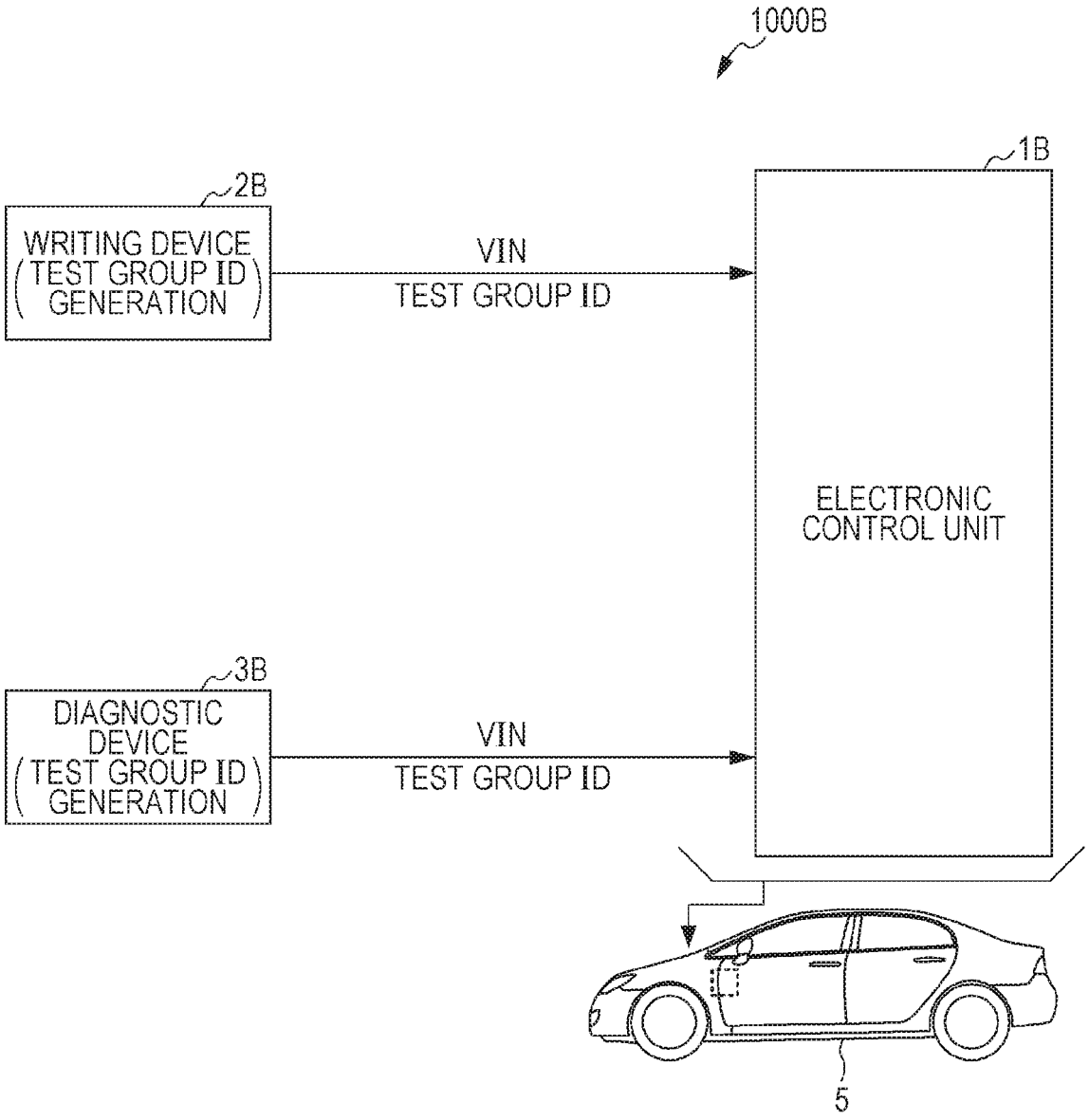
FIG. 14 is a diagram illustrating the system configuration of a test group identification information automatic generation system according to a third embodiment.

As illustrated in FIG. 14, a test group identification information automatic generation system 1000B according to the third embodiment includes an electronic control unit 1B, a writing device 2B, a diagnostic device 3B, and a vehicle 5.

[Electronic Control Unit 1B]

The function of the electronic control unit 1B is the same as the function of the electronic control unit 1A according to the second embodiment illustrated in FIG. 9. Specifically, the controller 11 (the CPU 11) causes the controller 11 (the CPU 11) to function as the VIN writing unit 110, the VIN reading unit 111, a test group ID storing unit 113A, and the completion unit 119A by executing programs (hereinafter also collectively referred to as the "test group ID storing program").

[Writing Device 2B]

Figure 15:
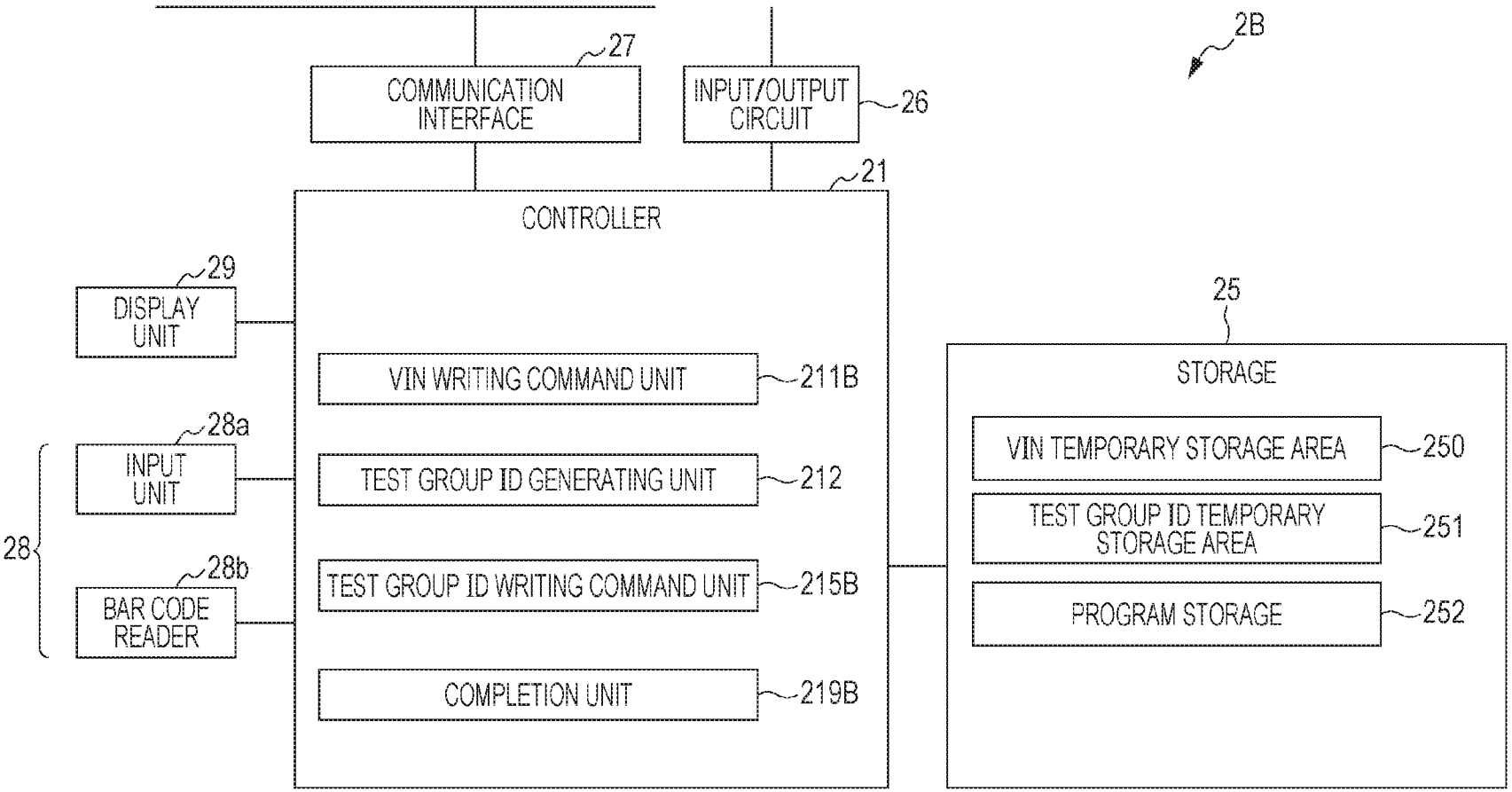
FIG. 15 is a functional block diagram illustrating the functional configuration of a writing device according to the third embodiment.

The functional configuration of the writing device 2B is illustrated in FIG. 15. The writing device 2B performs data communication with the electronic control unit 1B via the communication interface 37.

[Function of Writing Device 2B]

As illustrated in FIG. 15, the writing device 2B causes the writing device 2B to function as a VIN write command unit 211B, a test group ID generation unit 212, a test group ID write command unit 215B, and a completion unit 219B by executing programs for test group ID automatic generation by the controller 21 (the CPU 21). These functional units are collectively referred to as the "test group ID automatic generation unit".

The storage 25 includes the VIN temporary storage area 250, the test group ID temporary storage area 251, and the program storage 252 including programs for test group ID automatic generation.

The function of the VIN write command unit 211B is basically the same as the function of the VIN write command unit 211 of the writing device 2 according to the first embodiment.

In response to a completion (normal end) notification for VIN writing by the VIN write command unit 211 from the electronic control unit 1B, the test group ID generation unit 212 reads the VIN information stored in the VIN temporary storage area 250, or the VIN storage area 150 of the electronic control unit 1B, and determines and generates a test group ID. The test group ID generation unit 212 stores the generated test group ID in the test group ID temporary storage area 251. When a vehicle category and an emission control category corresponding to the attribute (vehicle model number) of the vehicle are provided as fixed parameter values in the program for test group ID automatic generation, the test group ID generation unit 212 may determine, and generate a test group ID by checking the fixed parameter values provided in the program.

In response to storing of the test group ID generated by the test group ID generation unit 212 in the test group ID temporary storage area 251, the test group ID write command unit 215B reads the test group ID stored in the test group ID temporary storage area 251, and transmits a write command for the test group ID to the electronic control unit 1B via the communication interface 27. In this manner, the test group ID write command unit 215B stores the test group ID in the test group ID storage area 151 of the new electronic control unit 1B prepared in advance. It is to be noted that the test group ID may be transferred from the test group ID generation unit 212 to the test group ID write command unit 215A, for instance, by interprocess communication.

The function of the completion unit 219B is basically the same as the function of the completion unit 219 of the writing device 2 according to the first embodiment.

[Diagnostic Device 3B]

Figure 16:
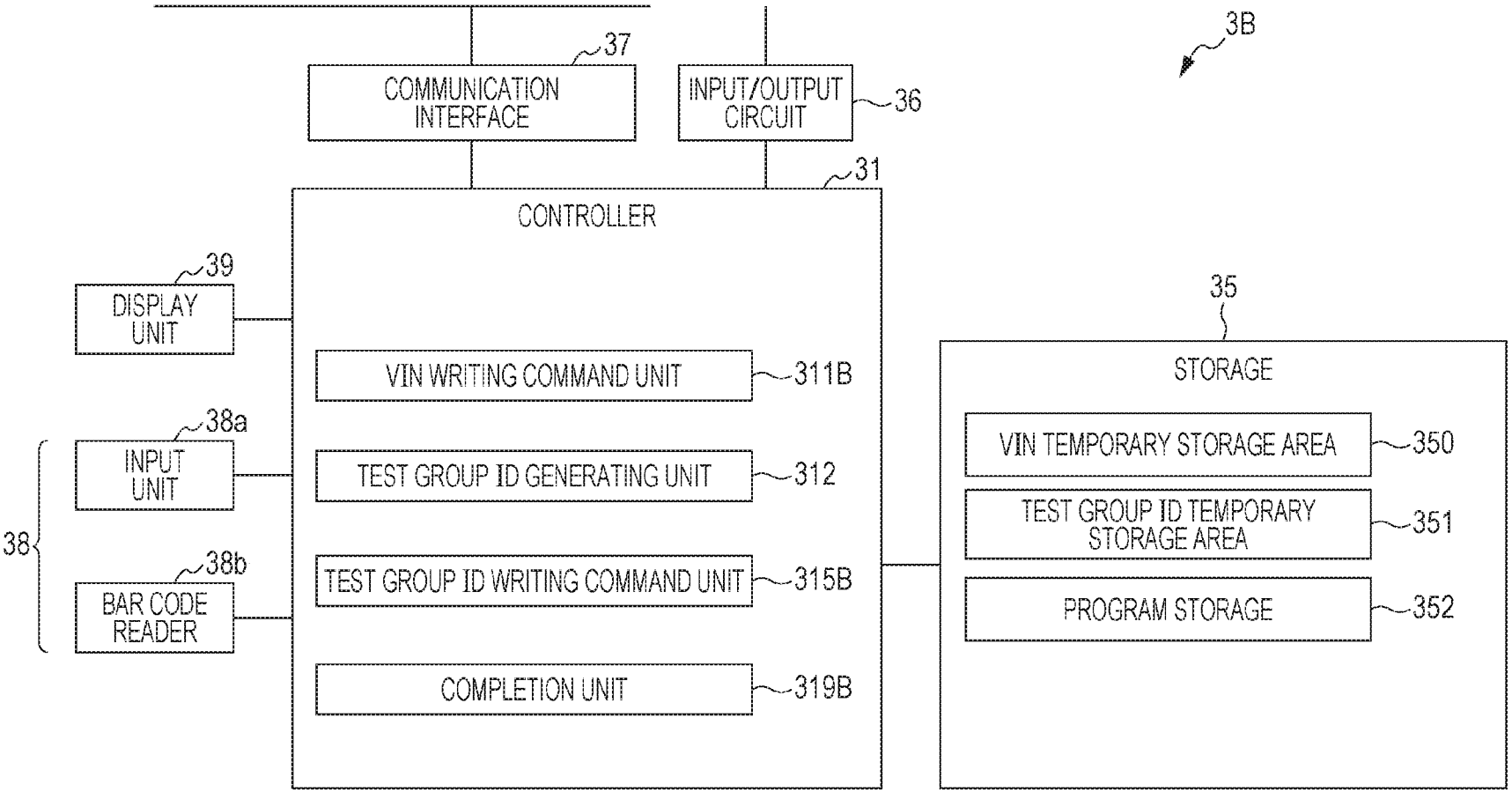
FIG. 16 is a functional block diagram illustrating the functional configuration of a diagnostic device according to the third embodiment.

The functional configuration of the diagnostic device 3B is illustrated in FIG. 16. The diagnostic device 3B performs data communication with the electronic control unit 1B and the management server 4B via the communication interface 37.

[Function of Diagnostic Device 3B]

As illustrated in FIG. 16, the diagnostic device 3B causes the diagnostic device 3B to function as a VIN write command unit 311B, a test group ID generation unit 312, a test group ID write command unit 315B, and a completion unit 319B by executing programs for test group ID automatic generation by the controller 31 (the CPU 31). These functional units are collectively referred to as the "test group ID automatic generation unit".

The storage 35 includes the VIN temporary storage area 350, the test group ID temporary storage area 351, and the program storage 352 including programs for test group ID automatic generation.

Here, the functions of the VIN write command unit 311B and the completion unit 319B are the same as the respective functions of the VIN write command unit 311 and the completion unit 319 of the diagnostic device 3, and thus a detailed description is omitted.

Also, the functions of the test group ID generation unit 312 and the test group ID write command unit 315B are the same as the respective functions of the test group ID generation unit 212 and the test group ID write command unit 215B of the writing device 2, in which the storage 25, the VIN temporary storage area 250, the test group ID temporary storage area 251, and the program storage 252 are replaced by the storage 35, the VIN temporary storage area 350, the test group ID temporary storage area 351, and the program storage 352, respectively, and thus a detailed description is omitted.

(Operation of Test Group Identification Information Automatic Generation System 1000B)

Figure 17A:
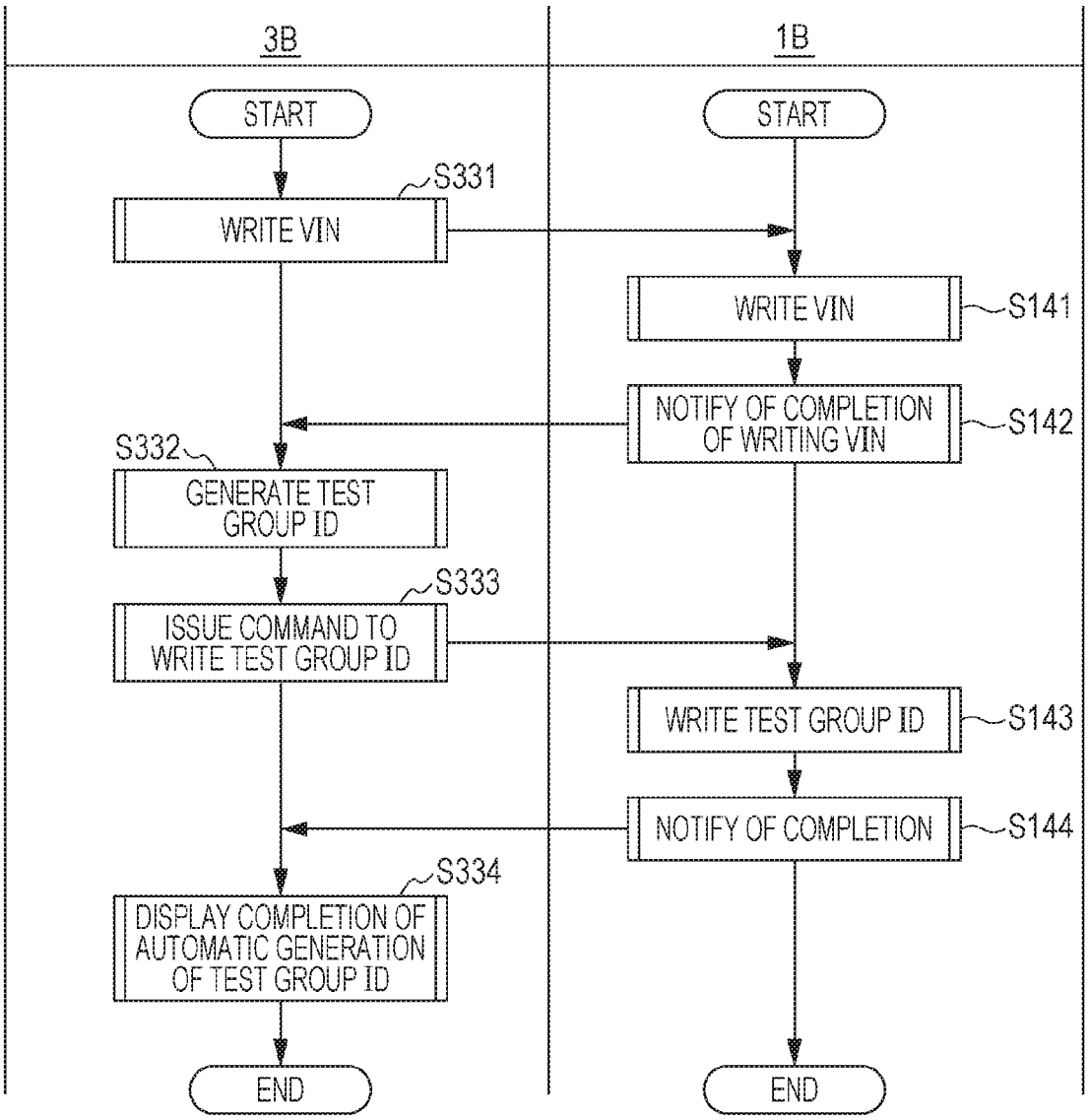
FIG. 17A is a flowchart illustrating the flow of processing of a test group identification information automatic generation system.
Figure 17B:
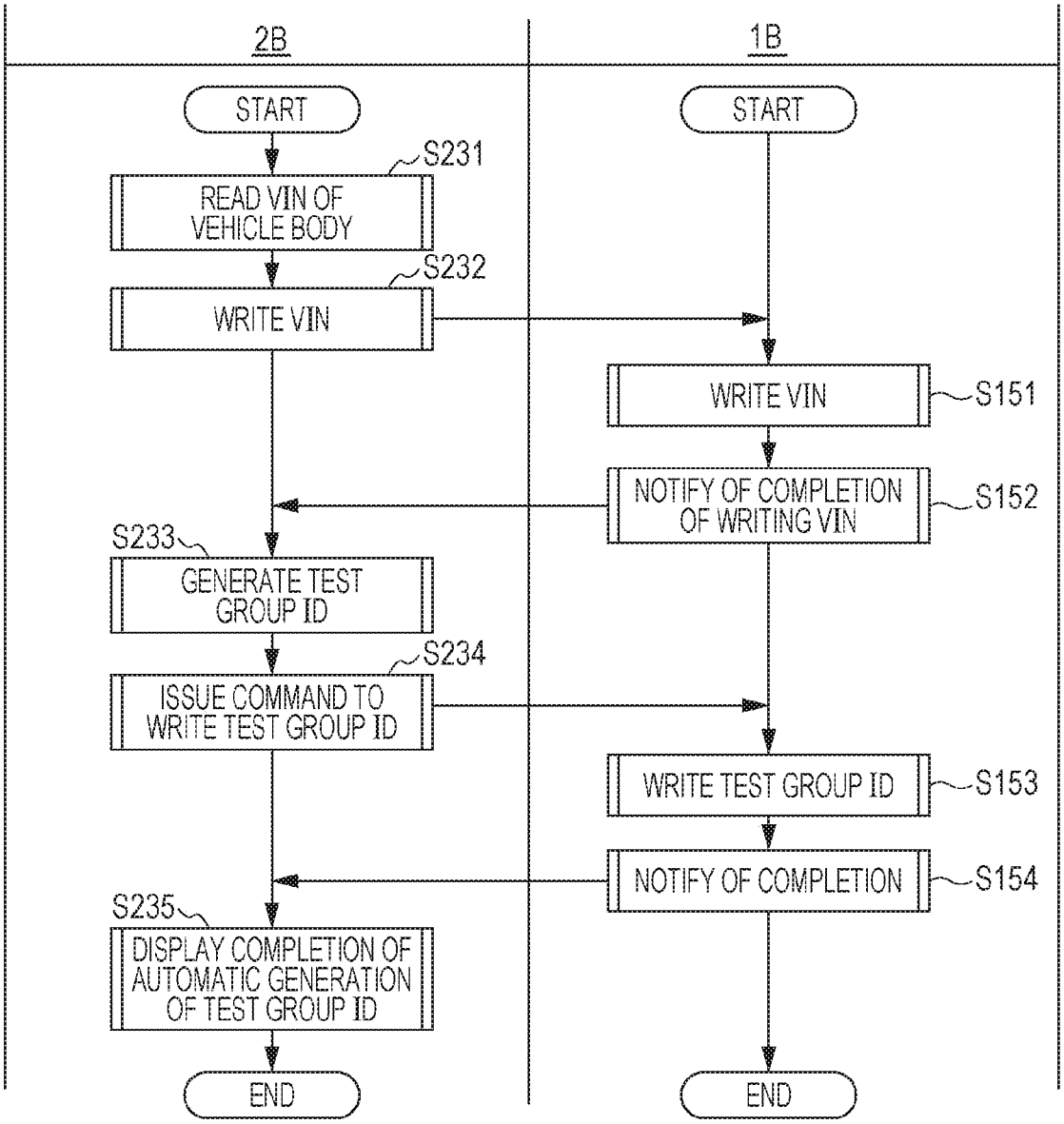
FIG. 17B is a flowchart illustrating the flow of processing of the test group identification information automatic generation system.

The configuration of the test group identification information automatic generation system 1000B has been described above. Next, the operation of the test group identification information automatic generation system 1000B will be described. FIGS. 17A and 17B are each a flowchart illustrating the flow of processing of the test group identification information automatic generation system 1000B.

First, referring to FIG. 17A, the operation for generation of test group identification information at the time of replacement of an electronic control unit 1B due to a cause such as a fault after vehicles come on the market will be described.

It is assumed that before generation processing for test group identification information is performed at the time of replacement of an electronic control unit 1B due to a cause such as a fault, the programs for test group ID automatic generation are pre-stored in the program storage 352 of the diagnostic device 3B, for instance, by an ECU supplier or an electronic control unit manufacturing department.

Referring to FIG. 17, first, the processing of the diagnostic device 3B is started.

(Processing of Diagnostic Device 3B)

In step S331, VIN is transmitted to a new electronic control unit 1B (for instance, manually via the diagnostic device 3B) by a worker who performs replacement work of the electronic control unit 1B. At this point, the diagnostic device 3B may store inputted VIN in the VIN temporary storage area 350.

(Processing of Electronic Control Unit 1B)

In step S141, the electronic control unit 1B (the VIN writing unit 110) stores the VIN received from the diagnostic device 3B in the VIN storage area 150, and sets the VIN storage area 150 to a VIN write completion state resulting in a data writing prohibited area.

In step S142, the controller 11 (the VIN writing unit 110) transmits a completion notification for VIN writing to the diagnostic device 3B.

(Processing of Diagnostic Device 3B)

In step S332, when receiving a completion notification for VIN writing from the electronic control unit 1B (new electronic control unit 1B), the diagnostic device 3B (the test group ID generation unit 312) determines, and generates a test group ID based on the VIN information inputted in step S331, and stores the generated test group ID in the test group ID temporary storage area 351.

In step S333, the diagnostic device 3B (the test group ID write command unit 315B) transmits a write command for the generated test group ID to the electronic control unit 1B via the communication interface 27.

(Processing of Electronic Control Unit 1B)

In step S143, when receiving the write command of test group ID from the diagnostic device 3B, the electronic control unit 1B (the test group ID storing unit 113A) stores the test group ID in the storage 15 (the test group ID storage area 151), and sets the test group ID storage area 151 to a test group ID write completion state resulting in a data writing prohibited area.

In step S144, in response to storing of the test group ID in the storage 15 (the test group ID storage area 151), the electronic control unit 1B (the completion unit 119A) notifies the diagnostic device 3B that storing of the test group ID in the test group ID storage area 151 has been completed.

(Processing of Diagnostic Device 3B)

In step S334, when receiving the completion notification for storing of the test group ID from the electronic control unit 1B, the diagnostic device 3B (the completion unit 319B) completes the test group ID automatic generation function. At this point, the diagnostic device 3B (the completion unit 319B) may display on the display unit 39 that storing of the test group ID in the replacing electronic control unit 1B (new electronic control unit 1B) has been completed.

Next, FIG. 17B is a flowchart illustrating the flow of the processing of the test group identification information automatic generation system 1000B at the time of production (for instance, an assembly process in which the engine is installed in the vehicle body) of finished vehicles.

The processing of the writing device 2B in step S233 to step S235 is the same as the above-described processing of the diagnostic device 3B in step S332 to step S334, in which the diagnostic device 3B is replaced by the writing device 2B, and a detailed description is omitted.

In step S231, the writing device 2B (the VIN write command unit 211B) reads the VIN of the vehicle body, for instance, from label information by the bar code reader 28*b*, and stores the read VIN in the VIN temporary storage area 250. Also, in step 232, the writing device 2B (the VIN write command unit 211B) reads the VIN stored in the VIN temporary storage area 250, and transmits a write command for the VIN to the electronic control unit 1B.

The processing of the electronic control unit 1B in step S151 to step S154 is the same as the above-described processing of the electronic control unit 1B in step S141 to step S144, in which the diagnostic device 3B is replaced by the writing device 2B, and a detailed description is omitted.

Since the third embodiment is configured as described above, the same effect as that of the first embodiment can be achieved.

For instance, at the time of production (for instance, an assembly process in which the engine is installed in the vehicle body) of finished vehicles, the test group ID is automatically generated in the electronic control unit 2B, and thus the possibility of intentional falsification can be eliminated and man-made mistakes can be prevented. Similarly, at the time of replacement of an electronic control unit 1B due to a cause such as a fault after vehicles come on the market, the test group ID is automatically generated in the diagnostic device 3B, and thus the possibility of intentional falsification can be eliminated and man-made mistakes can be prevented.

Although a preferred embodiment of the present disclosure has been described above, the present disclosure is not limited to the above-described embodiment, and may be changed as appropriate.

[First Modification]

In the embodiments (the first to third embodiments), the electronic control units 1, 1A, and 1B, the writing devices 2, 2A, and 2B, the diagnostic devices 3 and 3A, 3B, and the management servers 4 and 4B each functions as a predetermined functional unit by executing a predetermined program. However, programs may not be necessarily divided so as to correspond to the exemplified functional units.

For instance, a single program may correspond to the function of one or more functional units combined. Also, each functional unit may be further divided, and programs may correspond to the respective divided functional units.

For instance, in the electronic control unit 1 in the first embodiment, a single program may correspond to the VIN reading unit from the VIN storage area 150, the test group ID generation unit 112, the test group ID storing unit 113, and the completion unit 119. Also, in the management server 4 in the second embodiment, a single program may correspond to the VIN receiving unit 411, the test group ID generation unit 412, the test group ID transmitting unit 415, and the completion unit 419. Also, in the writing device 2B in the third embodiment, a single program may correspond to the test group ID generation unit 212, the test group ID write command unit 215B, and the completion unit 219B. Similarly, in the diagnostic device 3B, a single program may correspond to the test group ID generation unit 312, the test group ID write command unit 315B, and the completion unit 319B.

It is to be noted that when a program is divided into multiple programs, start-up of another program and transfer of processed data (or parameters) to another program may be performed, for instance, by applying a well-known art such as interprocess communication.

[Second Modification]

Although the management servers 4, 4B are implemented as a single server in the embodiments, as another embodiment, a distributed processing system may be implemented, in which the functions of the management servers 4, 4B are distributed to multiple servers. Alternatively, the functions of the management servers 4, 4B may be implemented by utilizing virtual server functions on the cloud.

[Third Modification]

In the embodiments, a "checking step (or processing step) by a worker" may be included as appropriate in a series of processes from the start to the end of the system. Although a specific form of embodiment has been described above and illustrated in the accompanying drawings in order to be more clearly understood, the above description is made by way of example and not as limiting the scope of the invention defined by the accompanying claims. The scope of the invention is to be determined by the accompanying claims. Various modifications apparent to one of ordinary skill in the art could be made without departing from the scope of the invention. The accompanying claims cover such modifications.

What is claimed is:

1. A method of automatically generating test group identification information for generating and storing test group identification information or engine family information of a vehicle including an electronic control unit including a storage, the method comprising steps of:

(i) reading a vehicle identification number stored in the storage, by the electronic control unit;

(ii) generating a manufacturer common model year in the test group identification information or the engine family information to generate the test group identification information or the engine family information based on information indicating a model year included in the vehicle identification number read in the step (i), by the electronic control unit; and (iii) storing the test group identification information or the engine family information generated in the step (ii) in the storage, by the electronic control unit, wherein the test group identification information and the engine family information respectively provide information about an emission control system and an exact standard that the vehicle was designed to meet.

2. The method of automatically generating test group identification information according to claim 1, wherein the electronic control unit has related information beforehand other than the model year used for generation of the test group identification information, and in the step (ii), the electronic control unit further generates the test group identification information based on the related information used for generation of the test group identification information.

3. The method of automatically generating test group identification information according to claim 2, wherein the electronic control unit has the related information pre-stored in the storage.

4. A non-transitory computer readable medium storing a program for causing the electronic control unit to perform the steps according to claim 1.

5. An electronic control unit comprising the non-transitory computer readable medium according to claim 4.

6. An electronic control unit configured to execute the steps according to claim 1.

7. A vehicle comprising the electronic control unit according to claim 6.

8. The method of automatically generating test group identification information according to claim 1, wherein the test group identification information and the engine family information respectively include information comprising a manufacturer common model year, a manufacture of the vehicle, a manufacturer common vehicle category, an engine displacement of the vehicle, an ID set by the manufacturer for each model year, and a law category.

9. A method of automatically generating test group identification information for generating and storing test group identification information or engine family information of a vehicle including an electronic control unit including a storage, the method comprising steps of:

(i) receiving a vehicle identification number by a management server from a diagnostic device or a writing device connected to the server to allow communication therebetween;

(ii) generating a manufacturer common model year in the test group identification information or the engine family information to generate the test group identification information or the engine family information based on information indicating a model year included in the vehicle identification number received in the step (i), by the management server; and transmitting the test group identification information or the engine family information generated in the step (ii) to the diagnostic device or the writing device, by the management server, wherein the test group identification information and the engine family information respectively provide information about an emission control system and an exact standard that the vehicle was designed to meet.

10. The method of automatically generating test group identification information according to claim 9, wherein the management server has related information beforehand other than the model year used for generation of the test group identification information or the engine family information, and in the step (ii), the management server further generates the test group identification information based on the related information used for generation of the test group identification information or the engine family information.

11. The method of automatically generating test group identification information according to claim 10, wherein the management server has a storage storing the related information pre-stored.

12. A non-transitory computer readable medium storing a program for causing the server to perform the steps according to claim 9.

13. The method of automatically generating test group identification information according to claim 9, wherein the test group identification information and the engine family information respectively include information comprising a manufacturer common model year, a manufacture of the vehicle, a manufacturer common vehicle category, an engine displacement of the vehicle, an ID set by the manufacturer for each model year, and a law category.

14. A method of automatically generating test group identification information for generating and storing test group identification information or engine family information of a vehicle including an electronic control unit, the method comprising steps of:

(i) generating a manufacturer common model year in the test group identification information or the engine family information to generate the test group identification information or the engine family information based on information indicating a model year included in a vehicle identification number, by a diagnostic device or a writing device connected to the electronic control unit to allow communication therebetween; and (ii) causing, by the diagnostic device or the writing device, the electronic control unit to store the test group identification information or the engine family information generated in the step (i) in a storage area of the electronic control unit, wherein the test group identification information and the engine family information respectively provide information about an emission control system and an exact standard that the vehicle was designed to meet.

15. The method of automatically generating test group identification information according to claim 14, wherein the diagnostic device or the writing device has related information beforehand other than the model year used for generation of the test group identification information or the engine family information, and in the step (i), the diagnostic device or the writing device further generates the test group identification information or engine family information based on the related information used for generation of the test group identification information or the engine family information.

16. The method of automatically generating test group identification information according to claim 15, wherein the diagnostic device or the writing device has a storage storing the related information pre-stored.

17. A non-transitory computer readable medium storing a program for causing the diagnostic device or the writing device to perform the steps according to claim 14.

18. The method of automatically generating test group identification information according to claim 14, wherein the test group identification information and the engine family information respectively include information comprising a manufacturer common model year, a manufacture of the vehicle, a manufacturer common vehicle category, an engine displacement of the vehicle, an ID set by the manufacturer for each model year, and a law category.

* * * * *